US012434882B2

(12) United States Patent
Eftink et al.

(10) Patent No.: US 12,434,882 B2
(45) Date of Patent: Oct. 7, 2025

(54) AXIAL CENTER LOCK, GRIP RELEASE TELESCOPING PACKAGE

(71) Applicant: MOCAP LLC, Park Hills, MO (US)

(72) Inventors: Lance Joseph Eftink, Leadington, MO (US); Samuel Joseph Kersley, Sheffield (GB)

(73) Assignee: MOCAP LLC, Park Hills, MO (US)

( * ) Notice: Subject to any disclaimer, the term of this patent is extended or adjusted under 35 U.S.C. 154(b) by 210 days.

(21) Appl. No.: 18/342,966

(22) Filed: Jun. 28, 2023

(65) Prior Publication Data

US 2025/0002215 A1 Jan. 2, 2025

(51) Int. Cl.
*B65D 21/08* (2006.01)
*B65D 50/04* (2006.01)
*B65D 51/24* (2006.01)

(52) U.S. Cl.
CPC ..... *B65D 21/086* (2013.01); *B65D 50/045* (2013.01); *B65D 51/245* (2013.01)

(58) Field of Classification Search
CPC ..... B65D 21/086; B65D 50/045
USPC ..... 220/7, 8
See application file for complete search history.

(56) References Cited

U.S. PATENT DOCUMENTS 4,046,279 A 9/1977 Rosler
4,279,355 A 7/1981 Schwartz et al.
4,596,340 A 6/1986 Luther
5,411,161 A 5/1995 Fish, Jr.
5,543,186 A 8/1996 Anderson et al.
5,605,242 A 2/1997 Hwang
5,680,949 A 10/1997 Roesler
D397,615 S 9/1998 Nash et al.
5,829,591 A * 11/1998 Lyons ..... B65D 21/086 220/8
6,202,876 B1 3/2001 DeJonge
6,484,897 B1 11/2002 Crawley
D558,451 S 1/2008 Roesler
8,397,911 B1 3/2013 Bauman
8,710,958 B2 4/2014 Yang et al.
(Continued)

FOREIGN PATENT DOCUMENTS

CN 305971787 8/2020
WO 1994024008 A1 10/1994
(Continued)

OTHER PUBLICATIONS

International Search Report and Written Opinion issued for Application No. PCT/US2022/022248, dated Jul. 5, 2022 (12 pages).
(Continued)

*Primary Examiner* — Jeffrey R Allen
(74) *Attorney, Agent, or Firm* — Armstrong Teasdale LLP

(57) ABSTRACT

A telescoping package assembly includes a plug portion and a cap portion each including a flat surface. One of the respective flat surfaces includes a series of lock openings and the other includes a lock projection that is selectively receivable in any one of the series of lock openings to adjust a length of the telescoping package assembly. A grip portion extends from the cap portion which is operable to deflect the flat internal surface and release the lock projection from one of the series of lock openings when subjected to an applied pressing force.

45 Claims, 21 Drawing Sheets

(56) References Cited

U.S. PATENT DOCUMENTS

| | | | | |
|---|---|---|---|---|
| 8,789,694 | B2 * | 7/2014 | Roesler | B65D 21/086 206/349 |
| 8,985,327 | B2 | 3/2015 | Roesler | |
| D741,709 | S | 10/2015 | Sohler | |
| 9,211,969 | B2 | 12/2015 | Maze et al. | |
| D748,813 | S | 2/2016 | Ishiguro et al. | |
| 9,296,511 | B2 | 3/2016 | Jones et al. | |
| 9,359,112 | B2 | 6/2016 | Hadar et al. | |
| 9,540,152 | B2 | 1/2017 | Roesler | |
| 9,622,565 | B2 | 4/2017 | Weigel et al. | |
| 9,630,744 | B2 | 4/2017 | Sohler | |
| 9,884,716 | B2 | 2/2018 | Minnette et al. | |
| 9,889,965 | B2 | 2/2018 | Morgan et al. | |
| D827,449 | S | 9/2018 | Roesler | |
| 10,792,120 | B2 * | 10/2020 | Whelan | A61B 17/00234 |
| 11,643,250 | B2 | 5/2023 | Kersley et al. | |
| 2006/0086755 | A1 | 4/2006 | Roth et al. | |
| 2006/0191947 | A1 | 8/2006 | Jedryk et al. | |
| 2006/0231444 | A1 | 10/2006 | Roesler | |
| 2007/0012693 | A1 | 1/2007 | Kummer | |
| 2007/0272698 | A1 | 11/2007 | Brown et al. | |
| 2014/0360908 | A1 | 12/2014 | Sorensen et al. | |
| 2015/0003886 | A1 | 1/2015 | Gallardo et al. | |
| 2015/0008153 | A1 | 1/2015 | Ackerman | |
| 2015/0076140 | A1 | 3/2015 | Roesler | |
| 2015/0076149 | A1 | 3/2015 | Roesler | |
| 2015/0344180 | A1 | 12/2015 | Shakoori Divani | |
| 2018/0153277 | A1 | 6/2018 | Domy | |
| 2018/0221836 | A1 | 8/2018 | Ni | |
| 2021/0147114 | A1 * | 5/2021 | Nyul | B65D 85/20 |
| 2022/0315283 | A1 | 10/2022 | Kersley | |

FOREIGN PATENT DOCUMENTS

| | | | |
|---|---|---|---|
| WO | 2013171749 | A1 | 11/2013 |
| WO | 2018002920 | A1 | 1/2018 |

OTHER PUBLICATIONS

Extendable Plastic Brush Case, Posted at Amaxon.com on Dec. 22, 2020 [site visited Jun. 17, 2022]. Available from internet, URL: <https://www.amazon.com/dp/B08R5RMQKT/> (2020).

Extended European Search Report issued for Application No. 24169063.5, dated Oct. 15, 2024 (10 pages).

* cited by examiner

AXIAL CENTER LOCK, GRIP RELEASE TELESCOPING PACKAGE

BACKGROUND OF THE INVENTION

The field of the invention relates generally to adjustable packages for universal use with objects of different size, and more specifically to telescoping packages that are adjustably lengthened or shortened to universally contain elongated objects of different length.

Packaging is known that is adjustable in size to accommodate various different elongated objects having different length. Such packaging generally includes a base piece and a cover piece that each include mating interlock features which allow the cover piece to be selectively locked in place in one of many different, gradated positions relative to the base piece in order to desirably accommodate different elongated objects inside having respectively different axial lengths. The adjustable nature of the lockable cover piece relative to the base piece is sometimes referred to as a telescoping arrangement wherein fine gradations of locked positions for the cover piece are possible for optimal use of the package with a set of different elongated objects having varied axial length. Such locking telescoping packages can be universally used with different objects of different length and advantageously avoid a need to provide separate, tailor-made or customized packaging for objects of different length. Such telescoping packages can also be provided in various different width and depth dimensions to accommodate packaged objects of various different size in addition to length.

While existing locking telescoping packages of the type described above have been desirably adopted in the marketplace to lower packaging costs and streamline packaging processes for sets of elongated objects having a range of axial lengths compatible with the telescoping packages, they have yet to fully meet the needs of the marketplace. Improvements are accordingly desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
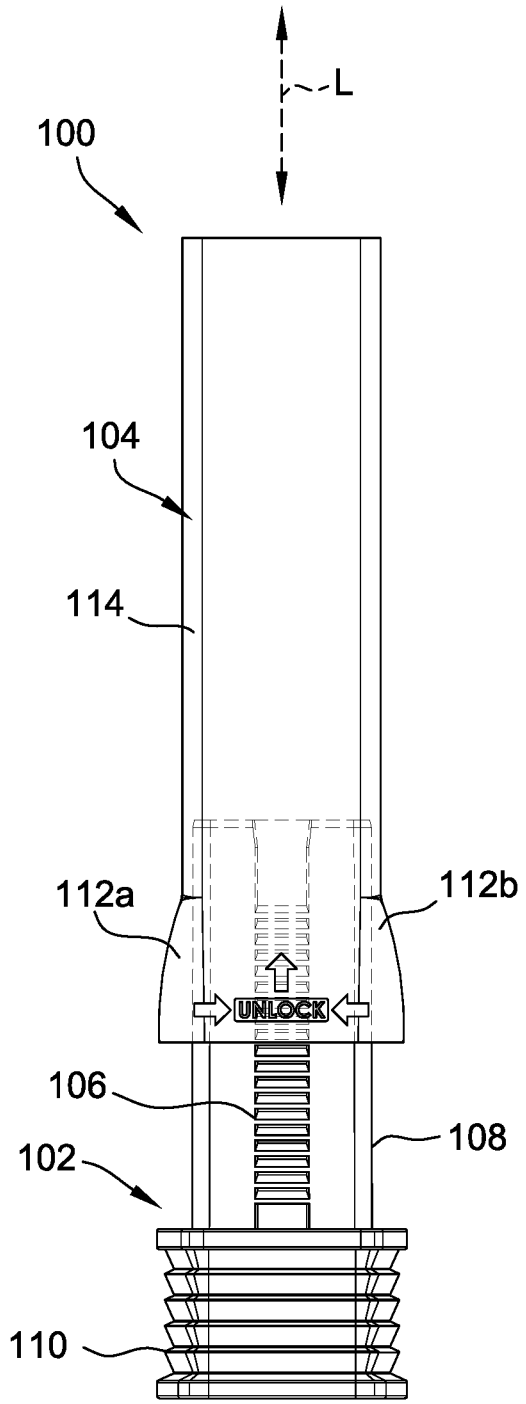
FIG. 1 is a side elevational view of an exemplary axial center lock, grip release telescoping package assembly in a first telescoping position according to an exemplary embodiment of the present invention.

In order to understand the invention to its fullest extent, some discussion of the state of the art of telescoping packages and certain problems in the art is warranted and is therefore discussed below, followed by a description of exemplary embodiments of improved product packages that beneficially overcome the problems in the art.

A variety of different adjustable length product packages are known and in use as a partial solution to unique product packaging needs for certain types of objects that are sold at retail points of sale. Generally speaking, existing adjustable length product packages for sets of elongated objects having respectively different axial length suffer from one or more issues that render them unsatisfactory and disadvantaged in certain aspects.

For example, some existing adjustable length product packages can be undesirably complicated from a manufacturing perspective and therefore may be manufactured at undesirably high manufacturing costs. Such complications may, for example, arise from overly complicated shapes of the base and/or cover pieces to achieve the desired adjustability, locking, and stability of the package. In general, simpler shapes of base pieces and cover pieces would realize cost savings from the manufacturing perspective.

Complicated shapes of base and cover pieces can also introduce difficulties in assembling the base and cover piece, particularly when the assembly requires intricate assembly steps and some level of dexterity to accomplish, which not all persons may possess. In cases where the pieces are assembled by hand at the manufacturing level before distribution, persons with limited dexterity may not easily complete relatively complex hand movements to assemble the telescoping packages, and in some cases may not be able to successfully complete package assembly at all. For other persons, complex hand movements required to assemble the packages may be difficult to master and apply in a repetitive manner without mistake.

In other cases wherein the pieces may be assembled in an automated manner, costs of automation may be undesirably increased by relatively complex machine movement required to engage the base and cover pieces in the telescoping package. Whether the telescoping packages are assembled by hand or by machine, lower cost packages with simplified assembly are accordingly desired.

Additionally, some existing adjustable length product packages can be undesirably complicated to use properly for certain users in the product distribution chain for reasons apart from dexterity limitations of the user to manipulate the package in certain ways. For instance, the proper sequence of steps or actions needed to be taken by the end user to adjust the package length to the desired position and securely lock the cover piece in place may be non-intuitive to end users who receive the base and package pieces in an unassembled state to package objects. Specifically, exactly how to assemble the base and cover pieces and/or align the mating features of the base and cover piece to position and lock the base piece and cover piece in the desired position may not be evident to such end users who are not as familiar with the package design as personnel of the package manufacturer. When the correct assembly steps are not clear, some confusion may result and the user may understandably try to assemble the cover piece to the base piece in the wrong position relative to the base piece, which will prevent the locking telescoping relationship from being established. Trial and error assembly steps in assembling the package may ensue that negatively affect efficiency of packing processes. If a frustrated user attempts to force fit the cover piece to the base piece, damage to either of the pieces may result, leading to undesirable scrapping of the package pieces or reliability issues for the packaging due to damage that may not be evident to the end user when it occurs. Inadvertent damage to the package results in increase of scrap material and reliability issues that may result when users may not appreciate that the package has been damaged.

Likewise, in the case where an end user may receive the package in an assembled form, exactly how to unlock the base piece or cover piece in order to adjust the package length may not be evident either. This is particularly so when locking features reside on the interior of the cover piece and are therefore not visible from the outside of the package, and also when the mating locking features on the base are partly or completely obscured to the end user by the cover piece. The user may experience some initial confusion regarding how to unlock the package to adjust its length. For example, the user may not quickly ascertain whether pushing, pulling, or other required action is needed unlock the base and/or cover piece to unlock them in order to select another position and adjust the package length. Trial and error attempts may again be undesirably made, as well as attempts to force the pieces apart which may damage the package pieces.

For users that eventually succeed to assemble, lock or unlock the packages without damaging them, confusion and mistake of the type described and associated trial and error before realizing specifically how to properly adjust the package size to the most desired size and/or to most effectively lock the package in the desired size introduces some delay and inefficiency in packaging products with optimal sizes of the packages. Inefficient use of the package leads to undesirable increases in labor cost to complete packaging processes.

For the reasons above, known telescoping packages have yet to cumulatively fulfill longstanding needs in the art for economic, telescoping packages that are more simply manufactured while also simplifying package assembly and operation to provide a more user friendly package that may be beneficially used with improved efficiencies in packaging processes.

Exemplary embodiments of improved telescoping packages are described below that overcome the issues above in the state of the art. The improved telescoping packages of the invention advantageously overcome the problems and deficiencies in the art by virtue of: (1) a relatively simpler shape of base and cover package pieces that may be more economically manufactured at lower cost: (2) transparent cover features permitting intuitive, visual alignment of locking features of the base piece and cover piece for the benefit of the end user; (3) axial center lock features that may be conveniently assembled, adjusted, locked and unlocked in an intuitive, self-guided manner: (4) a deflectable grip release feature to simply unlock the cover piece from the base piece and easily adjust its relative position to adjust the package length: (5) adjustment of the position of the cover piece relative to the base piece with a simplified press and push/pull motion that does not require more complicated positioning of the base piece and cover piece relative to one another; and (6) built-in intuitive visual cues to guide user assembly and operation of the packages to improve packaging efficiencies. Method aspects will be in part explicitly discussed and in part apparent from the following description.

FIGS. 1-4 illustrate an exemplary axial center lock, grip release telescoping package assembly 100 in a first telescoping position according to an exemplary embodiment of the present invention. The package 100 includes a generally hollow base piece 102, sometimes referred to as an inner piece or a plug, and a generally hollow cover piece 104, sometimes referred to as an outer piece or cap. The base piece 102 and cover piece 104 are each configured to be assembled to one another in an adjustable telescoping relationship relative to one another in a plurality of gradated positions imparting different axial length to the package 100 for optimal use to accommodate objects or items (not shown) having a range of axial lengths that may be fitted inside the package 100 at each respective gradated position. For the purposes herein, the elongated object is considered to fit optimally inside the package when the interior space of the package 100 at the selected one of the gradations positions is closest to but still slightly larger than the actual length of the object to be contained when the object is inside the package 100.

Figure 2:
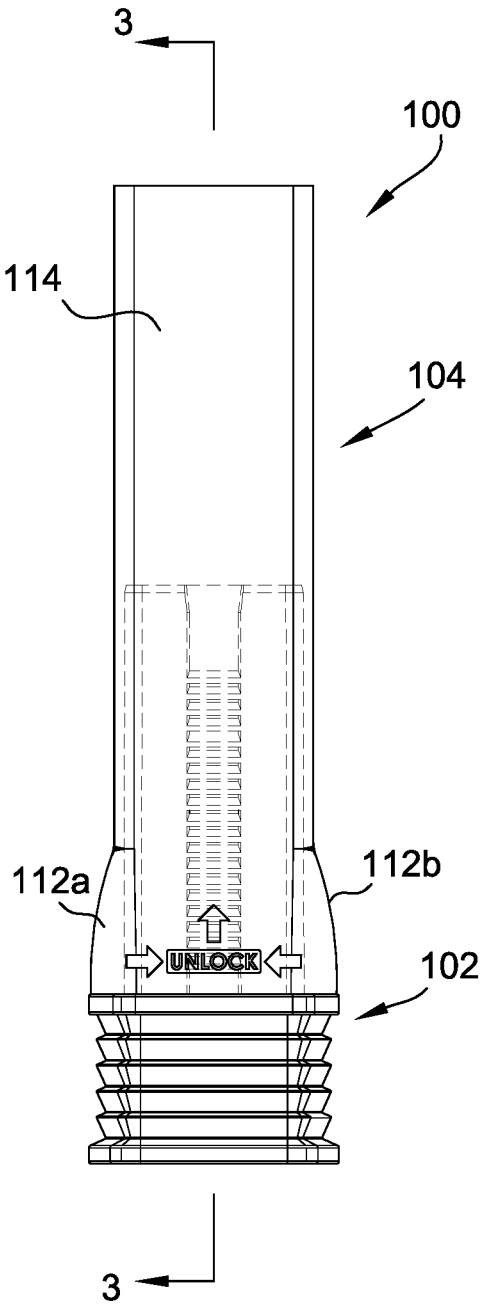
FIG. 2 is a side elevational view of the axial center lock, grip release telescoping package assembly in a second telescoping position.

FIG. 1 shows the package 100 in a first position wherein the cover piece 104 is extended relative to the base piece 102 to accommodate a longer object in the package 100. FIG. 2 shows the package 100 in a second position wherein the cover piece 104 is retracted relative to the base piece 102 to accommodate a shorter object in the package 100. In the example of FIGS. 1 and 2, the cover piece 104 may be adjustably positioned to extend farther away from the base piece 102 or closer to the base piece 102 in a number of respective, gradated positions to incrementally accommodate incremental differences in lengths of objects to be packaged. The package 100 may therefore be more or less universally used with a set of objects having respectively different length. Specifically, the package 100 may be adjusted in length for optimal use to accommodate objects or items (not shown) having a range of axial lengths that may be fitted inside the package 100 at each respective gradated position. In the context of FIGS. 1-4, the length dimension L corresponds to the longitudinal axis of the pieces 102 and 104 represented as a vertical axis in the plane of the pages of FIGS. 1-4. The longitudinal axis represented by L in FIG. 1 is also sometimes referred to herein as the "axial" direction.

The base piece 102 includes a plurality of exterior facing, rectangular lock openings 106 arranged adjacent one another in an axial alignment that is sometimes referred to as a "series" of openings 106 extending as a vertical column on the base piece 102 in the views of FIGS. 1-4. The series of lock openings 106 in the example shown is substantially centered on an exterior flat side surface of a polygonal plug portion 108 of the base piece 102 as shown in FIGS. 1 and 2. As seen in the sectional view of FIG. 3, the plurality of lock openings 106 are provided on opposing flat side surfaces of the polygonal plug portion 108 above a larger circumference finger grip portion 110 at a distal end of the base piece 102. The polygonal plug portion 108 having flat sides and flat or planar surfaces is specifically distinguished from round tubes having a circular cross-section that are known in certain types of conventional telescoping packages. Rectangular lock openings 106 are shown in FIGS. 1 and 2, although it is appreciated that non-rectangular lock openings may be incorporated in other embodiments.

The finger grip portion 110 likewise has a contoured outer surface to assist a user in gripping and holding the portion 110 in the use and handling of the package. In the illustrated example, the grip portion 110 includes a number of bands of angled surfaces which in combination present a roughened outer surface, rather than a smooth or flat outer surface, for a user to grasp without slipping. The roughened outer surface of the grip portion 110 may be formed in the fabrication of the base piece 102 via molding, or may be formed and applied via other known techniques in the art. The particular shape and geometry of the grip portion 110 shown and described is not required in all embodiments, and other shapes and geometries may be adopted with a similar purpose and effect.

In contemplated examples, the plug portion 108 in the base piece 102 has four flat sides and therefore four flat surfaces arranged orthogonally to one another, although four sides are not necessarily required in other embodiments and greater or fewer numbers of flat sides may be included. In some contemplated embodiments, the plug portion 108 may include a combination of flat sides and round sides, including but not limited to two flat sides and two round sides forming an oval-shaped cross-section. Various adaptations of shape and geometry of the plug portion 108 are possible including at least one flat side with the series of lock openings 106.

The cover piece 104 includes flared side wall portions 112*a*, 112*b* extending outwardly and away from a smaller circumference cap portion 114 that receives the plug portion 108 of the base piece 102. The flared portions 112*a*, 112*b* are rounded elements extending out of plane from otherwise flat or planar portions of the cap portion 114. The flat and planar portions of the cap portion 114 are complementary in shape to the plug portion 108 of the base piece 102 but slightly larger such that the plug portion 108 is received in the cap portion 114 when the package is assembled. As explained further below, the polygonal shapes of the plug portion 108 and the cap portion 114 confer a relatively simple assembly of the package 100 in the proper orientation relative to non-polygonal package pieces (e.g., cylindrical pieces having no flat sides) that may present greater ambiguity in the proper orientation for initial assembly.

Figure 3:
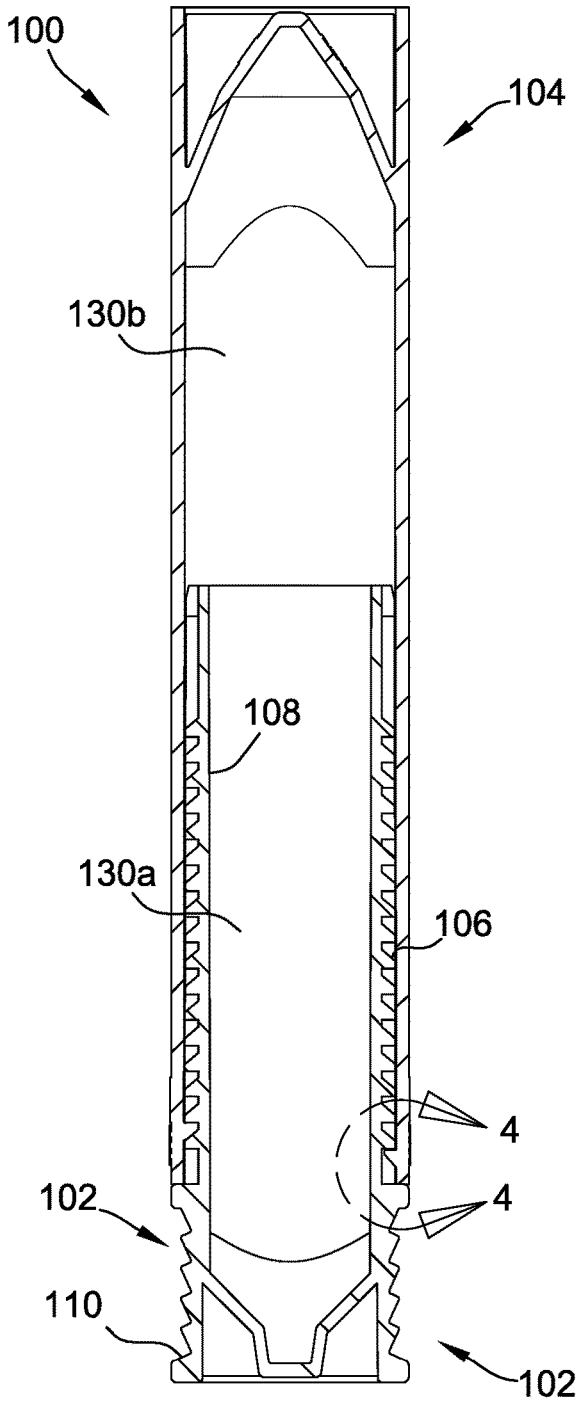
FIG. 3 is a sectional view of the axial center lock, grip release telescoping package assembly taken along line 3-3 in FIG. 2.
Figure 4:
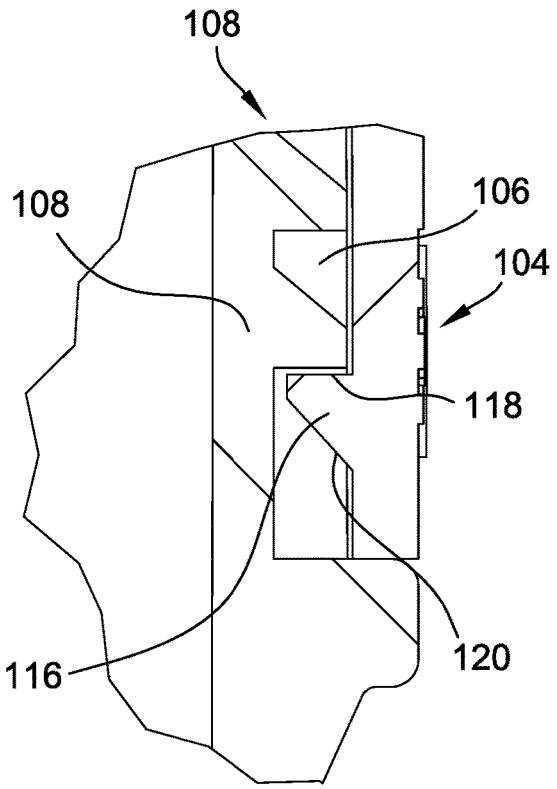
FIG. 4 is a detail view of a portion 4-4 of the axial center lock, grip release telescoping package assembly shown FIG. 3.

As best seen in FIGS. 3 and 4, the cover piece 104 includes a single lock projection 116 extending inwardly from a flat interior side wall surface of the cover piece 104 and therefore extending internally toward the plug portion 108 of the base piece 102. The single lock projection 116 is selectively receivable in the respective lock openings 106 of the base piece 102 at the gradated positions defined by the spacing between adjacent ones of the respective lock openings 106. In the embodiment shown, a single (i.e., only one) lock projection 116 is selectively receivable in any of the openings 106 provided to realize a range of axial lengths L of the telescoping package 100 in use. The single lock projection 116 is sufficient to provide the desired degree of locking while making it is easier to unlock the package relative to otherwise similar packages hanging multiple lock projections. In certain contemplated alternative embodiments, however, multiple lock protrusions may depend from the flat side wall of the cover piece 104 if desired.

By pressing respective the flared side wall portions 112*a*, 112*b* toward one another, such as with a pinching or squeezing action of a user with a thumb and forefinger of a first hand of the user to apply inwardly directed force to each side wall portion 112*a* and 112*b*, the proximal end of the cover piece 104 including the lock projection 116 is deflected outwardly and away from the plug portion 108 of the base piece 102. Such deflection releases the lock projection 116 from the opening 106 where it resided. Once the lock projection 116 is released, the base piece 102 is freely slidable relative to the cover piece 104 (or vice versa) to adjust the relative positions of the pieces 102, 104 and therefore the resultant length L of the package 100. When the user ceases to pinch or squeeze the flared side wall portions 112*a*, 112*b* the proximal end of the cover piece 104 including the lock projection 116 may return to its non-deflected position where it may again realize a locking engagement with one of the openings 106.

Figure 6:
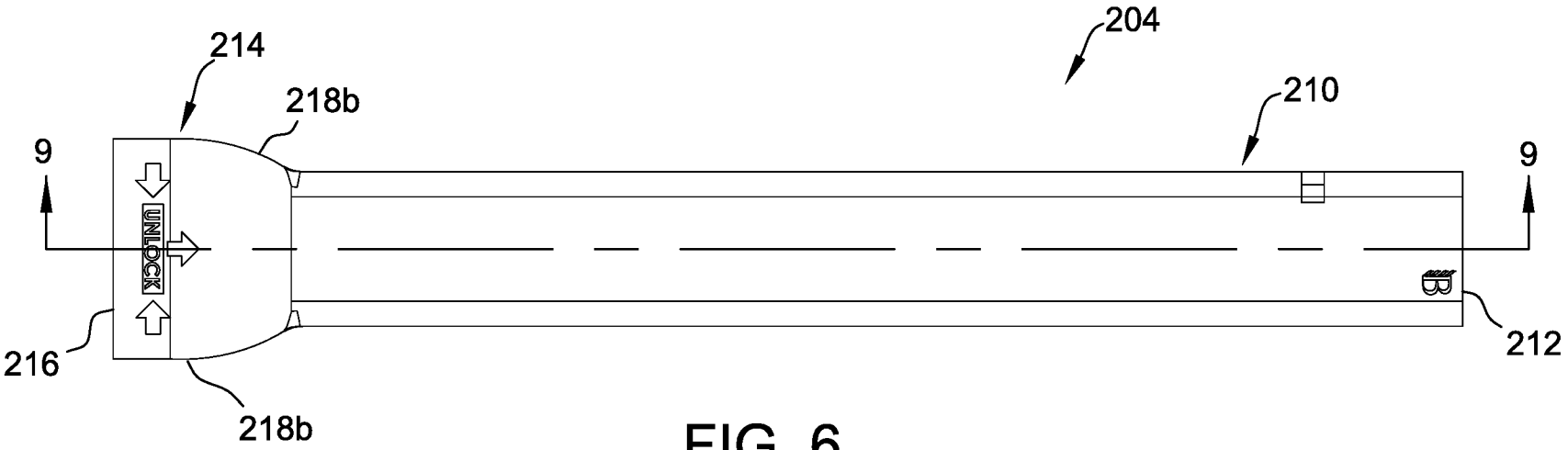
FIG. 6 is a side elevational view of the cover piece shown in FIG. 5.

As shown in FIG. 4, each locking projection 116 and opening 106 are complementary in shape, and in the illustrated example the projection 116 is a wedge shaped element having a flat shoulder surface extending perpendicularly to the axial centerline of the cover piece 104 and base piece 102 when the cover piece 104 is not deflected, and a ramp surface 120 extending obliquely to the axial centerline of the cover piece 104 and the base piece 102. The openings 106 likewise respectively include flat shoulder surface and ramp surfaces as shown in FIG. 6.

When the lock projection 116 is received in an opening 106, the flat shoulder surfaces of the base piece and the cover piece abut one another and in combination resist any attempt to pull the package pieces 102 and 104 apart in in a manner that would extend the package length or entirely separate the package pieces 102 and 104 in an upward vertical direction in the plane of the page of FIGS. 3 and 4. The ramp surfaces in the openings 106 and projection 116 provide comparatively little resistance, however, to applied force in the opposite direction to retract the package size. This means that, in the absence of any pressing force on the flared side walls 112*a* and 112*b*, the lock projection 116 may progressively slide past the lock openings to reach a desired retracted position of the package with little difficulty presented to the user applying an axially directed force in a downward direction in the plane of the page in FIGS. 3 and 4.

In use and operation of the package 100, when a user applies a downwardly directed pulling force on the grip portion 110 of the base piece 102 while the cover piece 104 is being deflected to unlock it, the relative position of the cover piece 104 can be easily extended further from the base piece 102 to increase the package length, up to a predetermined maximum length of the package 100. In other words, by gripping the flared portions 112*a*, 112*b* with one hand and pulling the grip portion 110 of the base piece with the other hand, the package length L can easily be increased. Alternatively, while holding the grip portion 110 of the base piece 102 still (i.e., stationary) the user may simultaneously apply a combination of pressure to the side walls 112*a* and 112*b* and an upwardly directed pushing force to separate the cover piece 104 farther from the base piece 102 and therefore easily increase the length L of the package 100. Either way, the required hand motions to increase the package length L are simpler than known telescoping packages that require rotation of the package pieces in addition to axial directed pushing or pulling force. Dexterity limitations and more complicated operations for human users, and the related problems discussed above are therefore avoided in the extension of the package 100 to accommodate larger objects.

When a user applies an upwardly directed pushing force to the grip portion 110 of the base piece 102 while the cover piece 104 is being deflected, the relative position of the cover piece 104 can be retracted relative to the base piece 102 to shorten the length of the package up to a predetermined minimum length of the package 100. In other words, by gripping the flared portions 112*a*, 112*b* with one hand and pushing the grip portion 110 of the base piece with the other hand, the package length can easily be decreased. Alternatively, while holding the grip portion 110 of the base piece still (i.e., stationary) the user may simultaneously apply a combination of deflection force to the side walls 112*a* and 112*b* and a downwardly directed pulling force to easily reduce a separation of the cover piece 104 relative to the base piece 102 and therefore decrease the length L of the package. Still further, a user can hold the base piece 102 still and, without deflecting the cover piece 102, pull the cover piece 104 down with sufficient force to cause the lock projection 116 to slide over the lock opening 106 via the ramp surfaces provided until the desired position of the cover piece 116 is reached. In any of these scenarios, the required hand motions to operate the package 100 to reduce the package length L are simpler than known telescoping packages that require rotation of the package pieces in addition to axial directed pushing or pulling force. Dexterity limitations and more complicated operations for users, and the related problems discussed above are therefore avoided in the retraction of the package 100 to accommodate larger objects In contemplated embodiments wherein the cover piece 104 is fabricated from a transparent material and the base piece 102 is fabricated from a non-transparent, colored material, the user can see through the cover piece 104 to select one of the available lock openings 106 in the base piece 102 and align the lock projection 116 without difficulty. Since the locking features 106 and 116 are clearly visible in such an embodiment, the user can simply and intuitively understand the locking mechanism and action required to achieve the optimal package length L. The package 100 is therefore easier to understand and use than existing packages wherein the locking features may be partly or entirely obscured from view and therefore present ambiguity to the user how the locking mechanism actually works.

As shown in FIGS. 1 and 2, the cover piece also includes visual cues such as oppositely directed arrows with the word UNLOCK in between the arrows to clearly instruct the user how to unlock the package via applied pressure on both of the flared side walls 112*a* and 112*b*, as well as an arrow pointing axially upwards to instruct the user to push or pull the cover piece 104 in the axial direction while the cover piece 104 is unlocked. Such visual cues may be built-in, raised molded features of the cover piece 104 in contemplated embodiments and therefore are visually prominent features. In other embodiments, the visual cues may be alternatively applied in graphic form with paint or color enhancement, a sticker or label, or by other means known in the art, albeit such graphic indicia that is not integrated or built-in to the molded package design is subject to wear that can reduce the visual prominence and visual cue for intuitive assembly of the package 100 over time.

The combination of visual cues in the package design and the transparent cover piece 104 confers a very user-friendly operation to the package 100. Via transparency and visual cues instructing the user, little to no ambiguity to the user is presented, and the locking/unlocking mechanism can be quickly understood and mastered by users without frustrating trial and error and the related problems discussed above. While greatly beneficial for the reasons stated, transparent cover features and such visual cues may be considered optional in some embodiments. That is, the cover may be fabricated from a non-transparent, colored material in certain embodiments, In still further embodiments the cover piece 104 could be partly transparent without being completely transparent, and may be provided with or without visual cues for reference by users when instructions or training for package operation are provided apart from the package itself or are otherwise deemed unnecessary because of the simplicity of package operation. Likewise, visual cues other than those shown and described may be incorporated in lieu of or in addition to the visual cues shown and described. In certain contemplated embodiments the base piece 102 may include visual cues in addition to or in lieu of visual cues provided on the cover piece 104.

As described above, a user may selectively lock, unlock and slide the cover piece 104 relative to the base piece 102 to extend or retract the package length L until the desired package length is realized. If the user extends or retracts the cover piece 104 too much or too little, simple corrections are possible with simple hand motions. Optimal packaging sizing for given objects may therefore be quickly and easily realized in the package 100 with improved efficiencies. Frustrating trial and error and associated problems discussed above are mostly, if not entirely, eliminated via the combination of features described above in the package assembly 100.

In contemplated embodiments, the object to be contained in the package 100 may reside generally vertically in the cumulative interior space 130*a* and 130*b* (FIG. 3) of each piece 102 and 104 at a locked position. The object to be contained may extend axially within the package pieces 102, 104 in FIG. 3 (i.e., along a vertical axis in the plane of FIG. 3), although in alternative embodiments the object to be contained may be misaligned (i.e., may extend at an angle relative to) with the longitudinal axis of the package and the length dimension L. Either way, the package 100 is finely adjustable to extend or retract the package size and the corresponding relative proportions of the interior spaces 130*a* and 130*b* for use of the package 100 with longer and shorter objects to be contained inside. Customized packages with specific length in a one-to-one correlation with objects of different length are therefore avoided with the telescoping features and adjustable length L of the package 100.

The base piece 102 and cover piece 104 are relatively simply shaped in comparison to certain types of telescoping package and may therefore be economically provided relative to other known telescoping packages having considerably more complex shapes. The base piece 102 and cover piece 104 as described and illustrated may be respectively formed and fabricated, for example, in an integral or one-piece structure having all the features shown and described from known plastic materials according to known molding processes. The base piece 102 and cover piece 104 may be fabricated from the same or different plastic materials as needed or as desired and in any respective color combination. In some cases, however, the base piece 102 or cover piece 104 may be fabricated in one or more parts that are assembled as a sub-assembly in the fabrication of the package 100.

Further details of base piece and cover pieces in telescoping packages employing similar locking and unlocking engagement to the package 100 are described in the following exemplary package assemblies.

Figure 5:
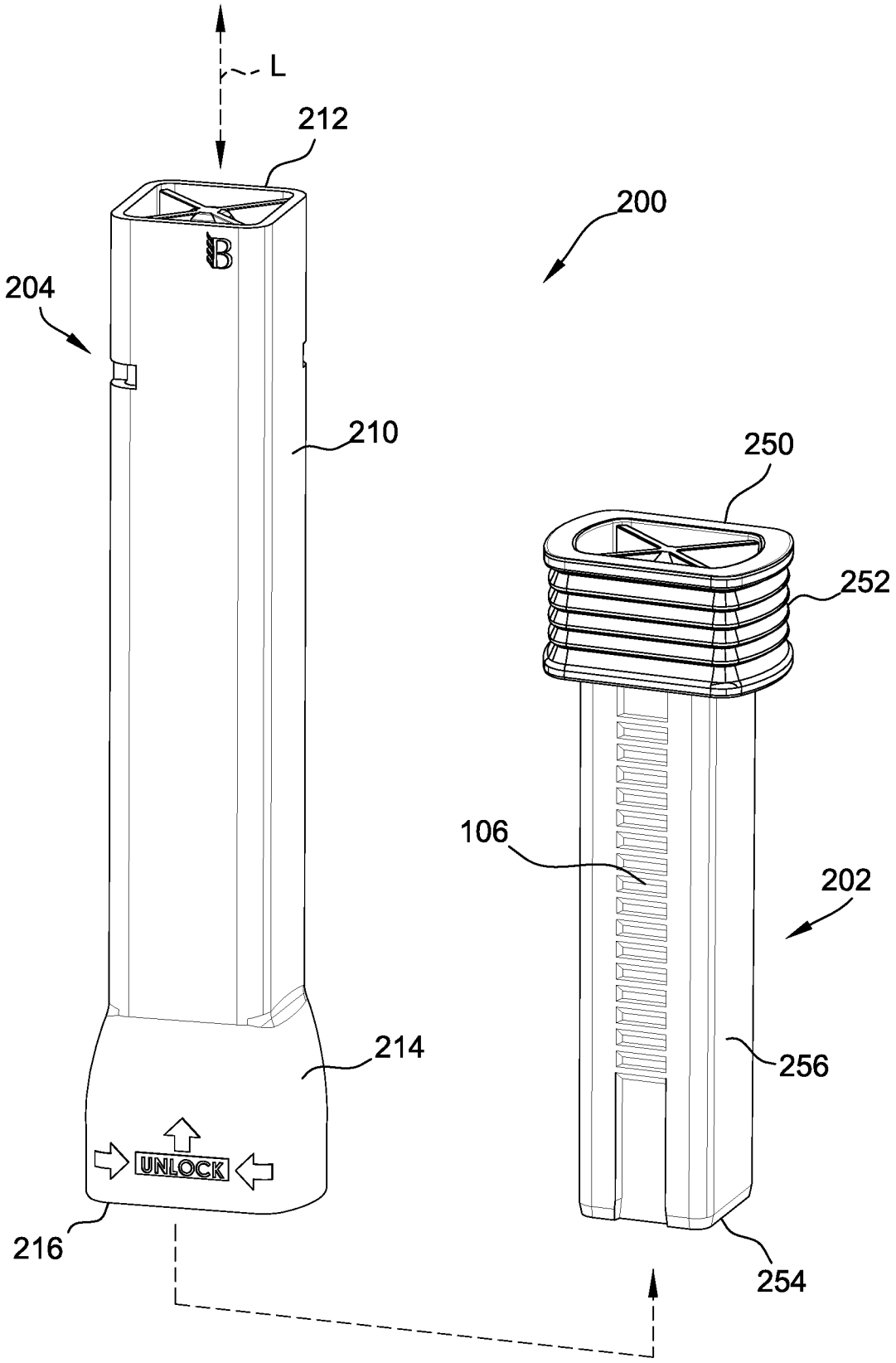
FIG. 5 is a first dis-assembled view of an exemplary axial center lock, grip release telescoping package assembly according to an exemplary embodiment of the present invention.

FIGS. 5-15 and 38-39 illustrate aspects of a first exemplary embodiment axial center lock, grip release telescoping package assembly 200 including a base piece 202 and cover piece 204. FIG. 5 shows the package assembly 200 in a dis-assembled state wherein the base piece 202 and cover piece 204 are separated from one another while FIGS. 38 and 39 respectively show the base piece 202 and cover piece 204 in a retracted position and an extended position.

Figure 38:
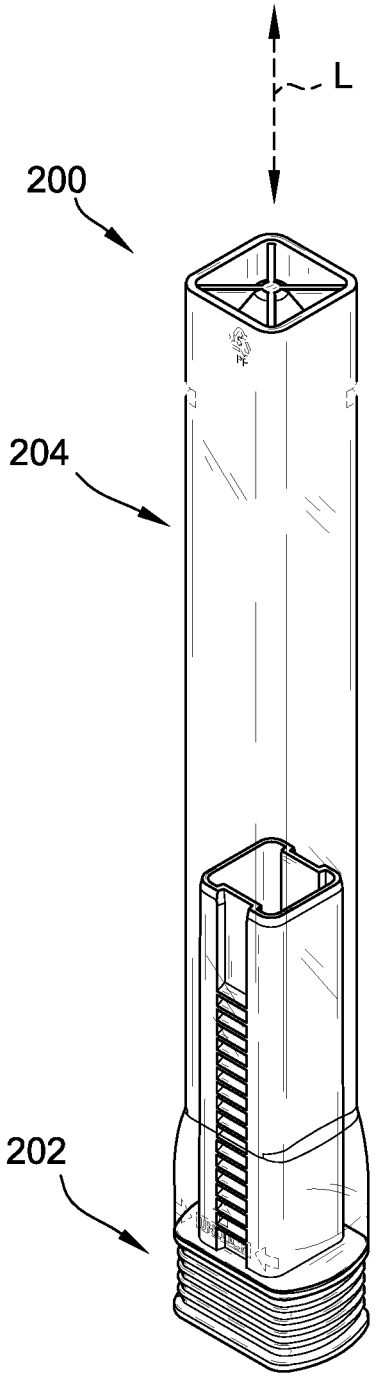
FIG. 38 is a perspective assembled view of the package shown in FIGS. 5-15 in a retracted position.

In the illustrated embodiment, the base piece 202 and cover piece 204 have respectively different overall length in the length dimension L (the vertical dimension in the plane of the page of the FIGS. 5 and 38). In a contemplated embodiment, the overall length of the base piece 202 measured between its opposing proximal and distal ends is about 33% to about 50% shorter than the overall length of the cover piece 104 measured between the proximal and distal ends thereof. Variations of relative overall lengths of the package pieces 202 and 204 are, of course, possible in alternative embodiments, including ones were the overall lengths of the pieces 202, 204 are about equal to one another. Likewise, embodiments are contemplated wherein the overall length of the base piece 202 may be longer than the overall length of the cover piece 204.

The structure and fabrication of the cover piece 204 is detailed in FIGS. 5-10. The cover piece 204 includes a hollow cap portion 210 defining a closed distal end 212, and a hollow grip portion 214 having an open proximal end 216. The open proximal end 216 may receive a portion of the base piece 202 when the package 200 is assembled. The cap portion 210 defines about 80% of the overall axial length L of the cover piece 204, while the grip portion 214 accounts for about 20% of the overall axial length of the base piece 204, although other relative lengths of the cap portion 210 and grip portion 214 are possible in other embodiments.

Figure 8:
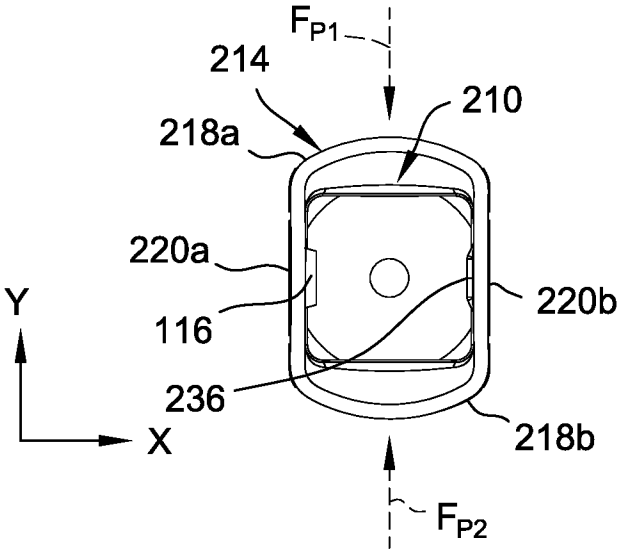
FIG. 8 is a bottom view of the cover piece shown in FIGS. 5 and 6.
Figure 7:
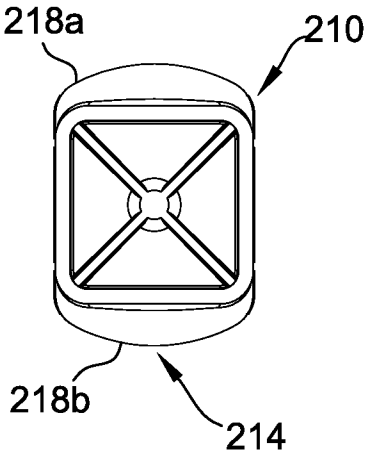
FIG. 7 is a top view of the cover piece shown in FIGS. 5 and 6.

The cap portion 210 is an elongated polygonal, hollow portion having four flat side walls and therefore four flat side surface arranged orthogonally to one another with rounded corner edges where the side walls intersect. As shown in FIGS. 5, 7 and 8 the four flat side walls of the cap portion 210 are about equally dimensioned in the x and y dimensions that extend perpendicular to the length dimension L extending in the z dimension in a Cartesian coordinate system. As such, in the top view shown in FIG. 7 from the distal end 212 and in the bottom view shown in FIG. 8 from the proximal end 216, the cap portion 210 is generally square in end view and in cross-section. By virtue of the equally dimensioned sides in the square arrangement, the cap portion 210 is an elongated square polygonal element. In other embodiments, unequally sized pairs of the cap portion 210 may define an elongated, rectangular polygonal shape to the cap portion 210. Still other shapes may be adopted in the cap portion, and the number of side walls in the cap portion may be varied. Combinations of flat sides and curved sides in the cap portion 210 are possible in certain embodiments. As such, the cross-section of the cap portion 210 may in various alternative embodiments be of any shape desired, non-limiting examples of which include circular, elliptical, oval, and polygonal shapes.

As shown in FIG. 6 in side view, and also in the top view shown in FIG. 7 from the distal end 212 and in the bottom view shown in FIG. 8 from the proximal end 216 of the cover piece 204, the grip portion 214 includes outwardly flared side walls 218*a*, 218*b* that are rounded at respective ends of opposing flat walls 220*a*, 220*b* extending parallel to one another in a spaced apart relationship. As such, the grip portion 214 appears as an oval in the top and bottom views of the base piece 204 as shown in FIGS. 7 and 8. In the top and bottom views of FIGS. 7 and 8, the opposing flat side walls 220*a*, 220*b* of the grip portion extend flush with (i.e., in the same plane as) respective ones of a pair of opposing side walls of the cap portion 210, while the opposing flared side walls 218*a*, 218*b* extend out of the plane of the second pair of opposing side walls of the cap portion 210. While a particular shape and geometry is shown and described for the grip portion 214, other shapes and geometries are possible in other embodiments.

When the flared side walls 218*a*, 218*b* are gripped with a user's fingers and are respectively pressed from opposing directions (indicated in FIG. 8 as $F_{P1}$ and $F_{P2}$) at the same time, the flared side walls 218*a*, 218*b* deflect inwardly in a direction toward one another due to the applied force. The inward deflection of the flared side walls 218*a*, 218*b* reduces the curvature of each of the flared side walls 218*a*, 218*b* in a manner that tends to flatten the curved walls 218*a*, 218*b*. In turn, the flattening of the flared side walls 218*a*, 218*b* causes the flat side walls 220*a*, 220*b* to deflect outwardly in a direction away from one another and oriented perpendicularly to the applied forces as $F_{P1}$ and $F_{P2}$. The flat sides 220*a*, 220*b* become curved or bowed as they are outwardly deflected. As such, and in the plane of the page in FIG. 8, as the grip portion 214 is pinched or squeezed in the vertical direction to apply pressure and therefore generate the applied forces $F_{P1}$ and $F_{P2}$ the grip portion 214 contracts in the y dimension (i.e., the vertical dimension in FIG. 8) as the flared side walls 218*a*, 218*b* are bowed inwardly while the grip portion 214 expands in the x dimension (i.e., the horizontal dimension) as the side walls 220*a*, 220*b* are bowed outwardly. The deflection or bowing of the side walls 220*a*, 220*b* is most pronounced at the proximal leading end 216 of the grip portion 214, and the deflection gradually reduces along the axial length of the grip portion 214 until the deflection entirely ceases. When the user ceases to apply the forces $F_{P1}$ and $F_{P2}$, however, the grip portion 214 resiliently returns to its initial position shown in FIG. 8.

As shown in FIGS. 5 and 7, diagonal cross-bracing resembling the letter x is provided at the closed distal end 212 of the cap portion 210. The cross bracing imparts a degree of stiffness to the distal end 212 that resists deflection of the cap portion 210 in the use and handling of the package 200 and/or imparts additional strength at the distal end 212 to ensure that the object contained in the package will not rupture the distal end 212. It is recognized, however, that such diagonal cross-bracing is not necessarily required in all embodiments and other types of bracing having different shape and geometry may be incorporated in other embodiments when desired and as needed. Likewise, in certain embodiments any such bracing of the distal end 212 may be considered optional and may therefore be omitted.

Figure 9:
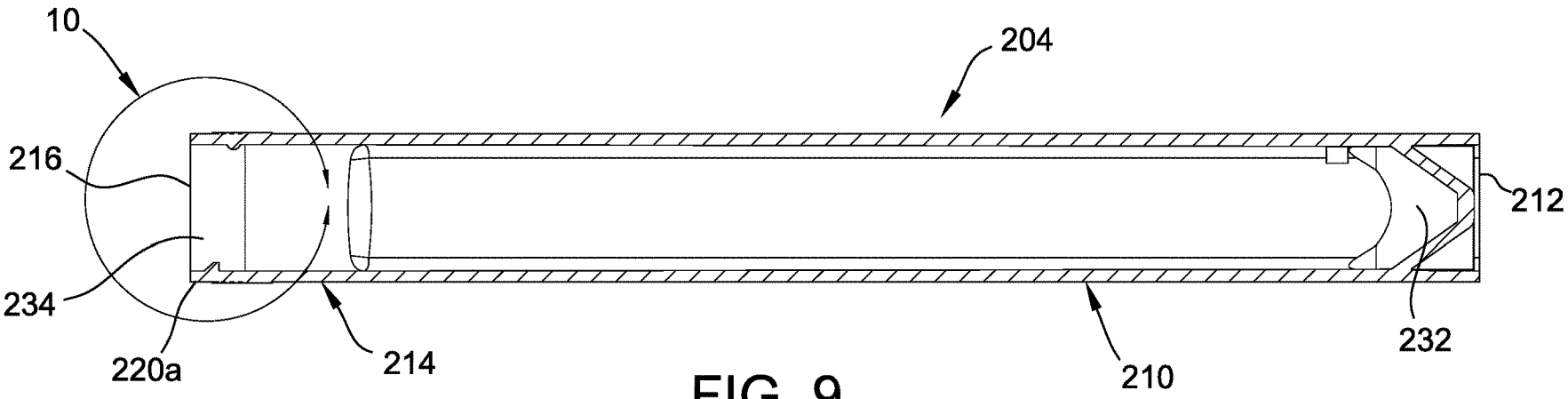
FIG. 9 is a sectional view of the cover piece taken along line taken along line 9-9 in FIG. 6.
Figure 10:
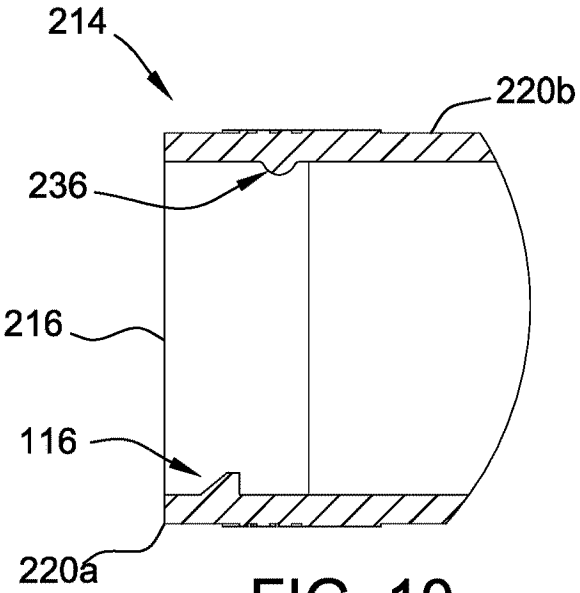
FIG. 10 is a detail view of a portion of FIG. 9.

As shown in the sectional view of FIG. 9 and the magnified view of FIG. 10, the cap portion 210 is hollow to define a first interior space 230 including a conical recess 232 at the closed distal end 212. The conical recess 232 may assist in orienting the object to be packaged in an upright position generally aligned with the axial length of cover piece 204, which coincides with the axial length of the package 200 when assembled to the base piece 202.

The grip portion 214 is likewise hollow to define a second interior space 234, and the lock projection 116 extends internally from the side wall 220*a* of the grip portion 214 at a slight distance from the proximal end 216 as shown in FIGS. 8 and 9. As also shown in FIGS. 7-9, a counter projection 236 extends internally from the opposing side wall 220*b* of the grip portion. The counter projection 236 is differently shaped from the wedge shaped lock projection 116 and in the example shown is rounded and generally semi-circular in cross-section. The projection 236 is also axially offset from the projection 116 in that is it located farther from the proximal end 216 than the projection 116. Both of the projections 116 and 236 are substantially centered between the longitudinal side edges of the side wall 220*a* or 220*b*. although they need not necessarily be centered in other embodiments.

In combination, the projections 116 and 236 stably engage the exterior surfaces of the base piece 202 from the opposing internal sides of the grip portion 214. The cap portion 210 is therefore supported on both sides in the assembled package via the projections 116 and 236 when assembled to the base piece 202. Both of the projections 116 and 236 may engage lock openings 106 in the base piece 202 while only one of them (namely the lock projection 116) positively locks the cover piece 204 in place. Both of the projections 116 and 236 may be deflected away from the base piece 102 when a user presses on the flared side walls 218*a*, 218*b* as described above in order to release the locking engagement and render the position cover piece 204 freely adjustable relative to the base piece 202 in order to adjust the axial length L of the package 200 to a more extended position or a more retracted position. Likewise, both of the projections 116 and 236 may slide over the lock openings 106 with relative ease to retract the cover piece 204 upon the base piece 202 without having to press on the side walls 218*a*, 218*b*.

The structure and fabrication of the base piece 202 is detailed in FIGS. 5 and 11-15. The base piece 202 includes a distal end 250 and a grip portion 252 extending at the distal end 250. The base piece 202 further includes a proximal end 254 and a plug portion 256. In the illustrated example, the plug portion 256 extends in the length direction for about 80% of the overall axial length of the base piece 202, with the grip portion 252 extending in the length direction for about 20% of the overall axial length of the base piece 202. Variations in the relative axial length of the grip portion 252 and the plug portion 256 are possible in other embodiments.

Figure 11:
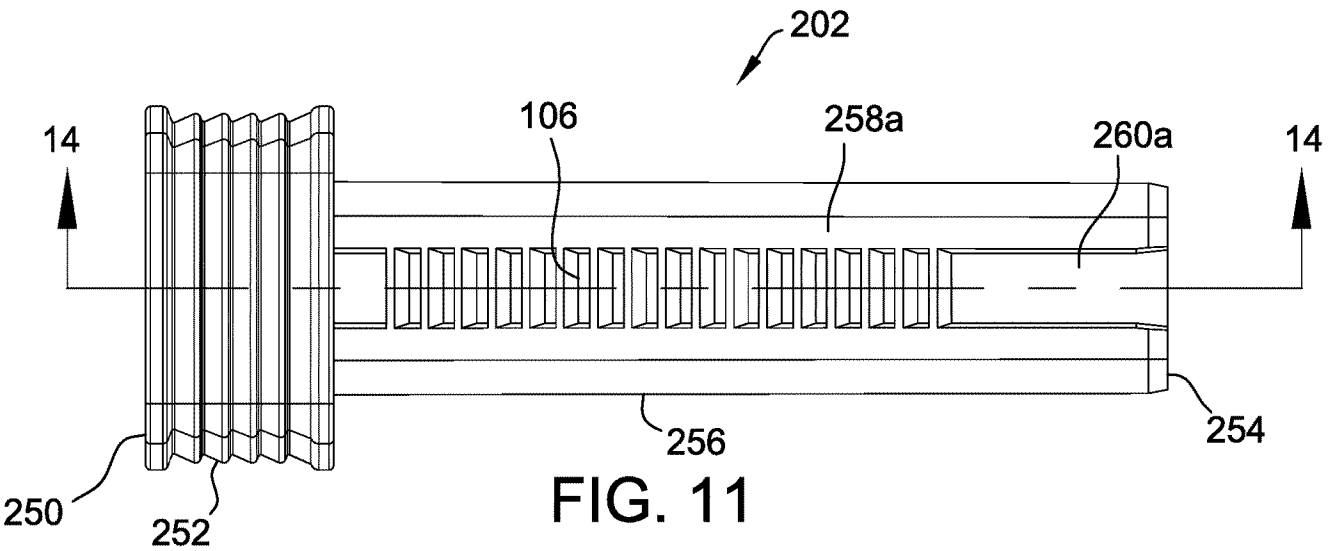
FIG. 11 is a side elevational view of the base piece shown in FIG. 5.
Figure 13:
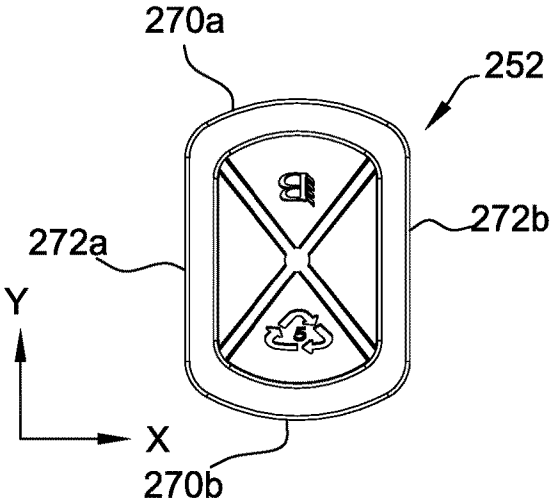
FIG. 13 is a bottom view of the base piece shown in FIGS. 5 and 11.
Figure 12:
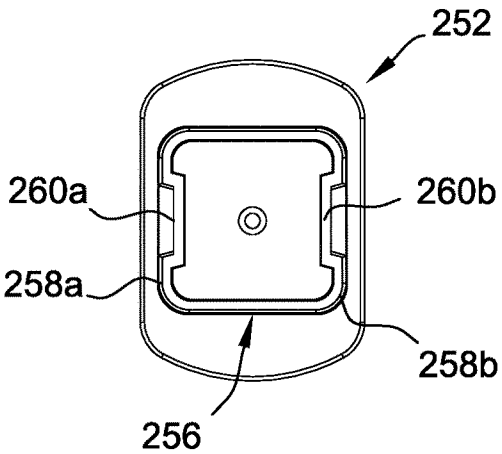
FIG. 12 is a top view of the base piece shown in FIGS. 5 and 11.
Figure 39:
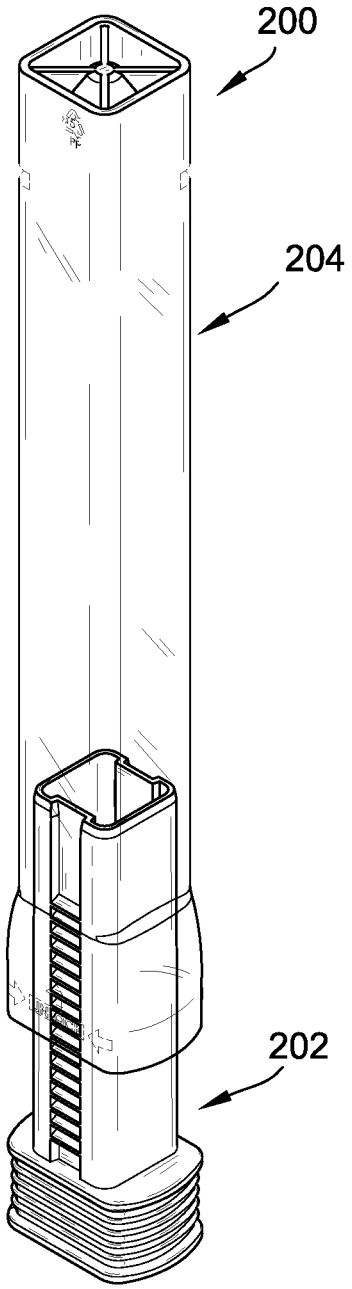
FIG. 39 is a perspective assembled view of the package shown in FIG. 38 in an extended position.

The plug portion 256 in the example shown has an elongated polygonal, hollow portion having four flat side walls and therefor four flat surfaces arranged orthogonally to one another. Rounded corner edges are provided where the side walls intersect as shown. As shown in FIGS. 11, 12 and 13 the four flat side walls of the plug portion 256 are about equally dimensioned in the x and y dimensions that extend perpendicular to the length dimension L extending in the z dimension in a Cartesian coordinate system. As such, in the top view shown in FIG. 12 from the proximal end 254 and in the bottom view shown in FIG. 13 from the distal end 250, the plug portion 256 is generally square. The square plug portion 256 is therefore complementary in shape to the square cap portion 210 of the cover piece 204, and when assembled the plug portion 256 is inserted into and received by the cap portion 210 and/or the cap portion 210 is inserted over and received by the cap portion 256 as shown in FIGS. 38 and 39. In other embodiments, rectangular plug portions (i.e., plug portions having opposed sides of unequal dimension) are possible, and the number of side walls in the plug portion may be varied. Combinations of flat sides and curved sides in the plug portion are also possible, so long as the shapes of the plug portion and the cap portion are compatible with one another for assembly.

Opposing side walls 258*a*, 258*b* of the plug portion 256 include elongated grooves 260*a*, 262*b*. The grooves 260*a*, 260*b* respectively receive the projections 116 and 236 when the proximal end 216 of the cover piece 204 is assembled with the proximal end 254 of the base piece 202. As such, the base piece 202 and cover piece 204 may be assembled in a one-way orientation that is relatively intuitive to the assembler. If the projections 116, 236 are not aligned with the grooves, difficulties in assembling the package will become apparent to the assembler. It would not be possible to lockingly engage the cover piece 204 to the base piece 202 unless the projections 116, 236 are aligned with an received in the grooves 260*a*, 262*b*. The series of lock openings 106 are also aligned with the grooves 260*a*, 262*b*. In the views of FIGS. 11 and 12, the grooves 260*a*, 262*b* and lock openings 106 are centered between the opposing longitudinal side edges of the walls 258*a*, 258*b*, while in other embodiments the grooves 260*a*, 262*b* and lock openings 106 may be off-centered but still spaced from each of the opposing longitudinal side edges of the walls 258*a*, 258*b*.

As shown in FIG. 11 in side view, and also in the top view shown in FIG. 12 from the proximal end 254 and in the bottom view shown in FIG. 13 from the distal end 250, the grip portion 252 includes outwardly flared side walls 270*a*, 270*b* that are rounded at opposing ends of flat walls 272*a*, 272*b*. As such, the grip portion 252 is oval-shaped in the top and bottom views of FIGS. 12 and 13. While a particular shape and geometry is shown and described, other shapes and geometries are possible for base piece 202 in other embodiments.

As shown in the bottom view of FIG. 13 at the distal end 250, the grip portion 252 includes diagonal cross-bracing in the shape of the letter x which provides a stiffness to the grip portion 252 to resist deflection thereof. As such, when gripped by a user, the grip portion 252 is not intended to deflect and instead is designed to maintain its shape even when subjected to force in the use and operation of the package. In other embodiments, however, such diagonal cross-bracing is not necessarily required in all embodiments and therefore other types of bracing having different shape and geometry may be incorporated if needed. Likewise, in certain embodiments bracing of the grip portion 252 may be considered optional and may therefore be omitted.

Figure 14:
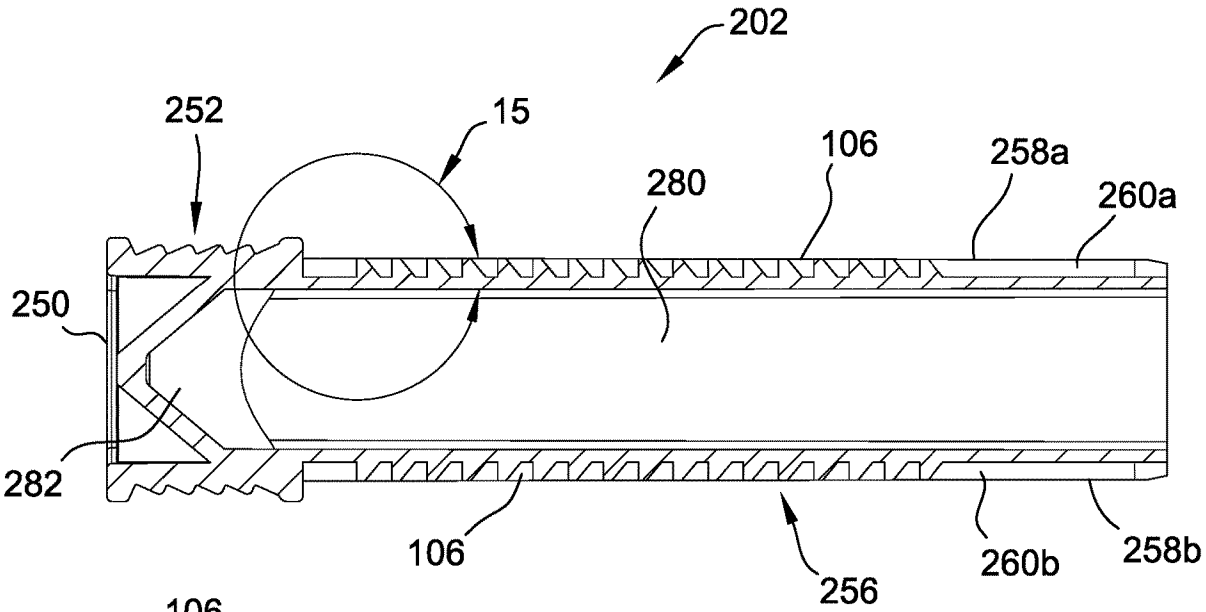
FIG. 14 is a sectional view of the base piece taken along line 14-14 in FIG. 11.
Figure 15:
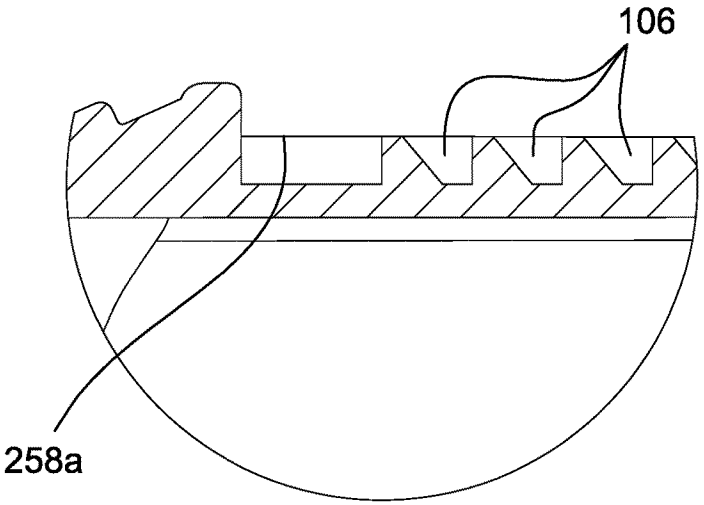
FIG. 15 is a detail view of a portion of FIG. 14.

As shown in the sectional view of FIG. 14 and the magnified view of FIG. 15, the plug portion 256 is hollow to define a first interior space 280 The grip portion 214 is likewise hollow to define a second interior space including a conical recess 282 at the closed distal end 250. The conical recess 282 may assist in orienting the object to be packaged in an upright position generally aligned with the axial length of the package 200. The lock openings 106 extend generally flush with and are accessible from the opposed outer walls of the plug portion 256 as shown in FIGS. 14 and 15. When the package 200 is assembled as shown in FIGS. 38 and 39, the user of the package can selectively lockingly engage the cover piece 204 with any of the lock openings 106 provided to conveniently adjust the length of the package 200 for different objects. The benefits of the package 200 are therefore similar to the package 100.

FIGS. 16-26 and 40-41 illustrate aspects of a second exemplary embodiment of an axial center lock, grip release telescoping package assembly 300 including a base piece 302 and cover piece 304.

Figure 16:
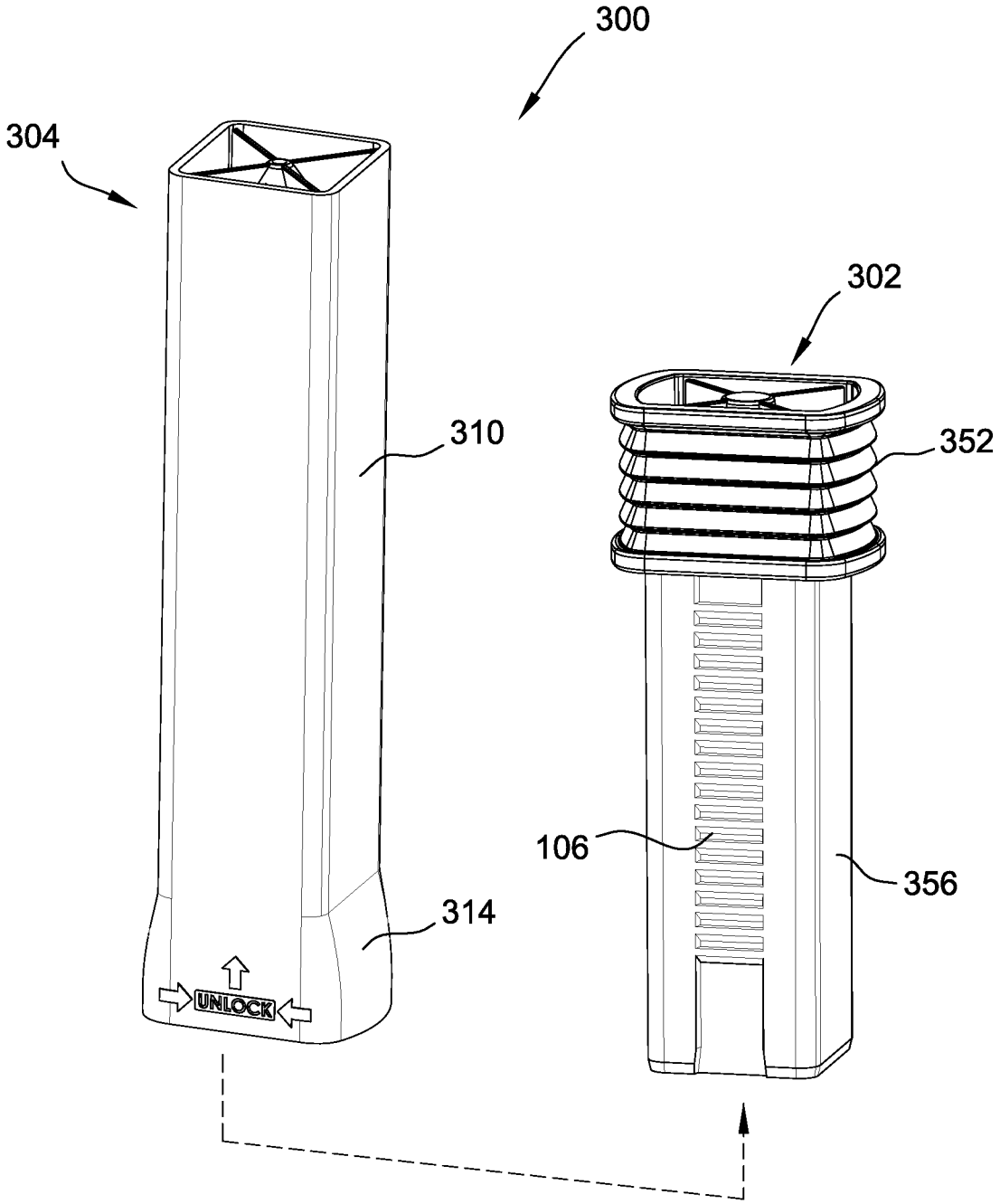
FIG. 16 is a second dis-assembled view of an exemplary axial center lock, grip release telescoping package assembly according to an exemplary embodiment of the present invention.
Figure 17:
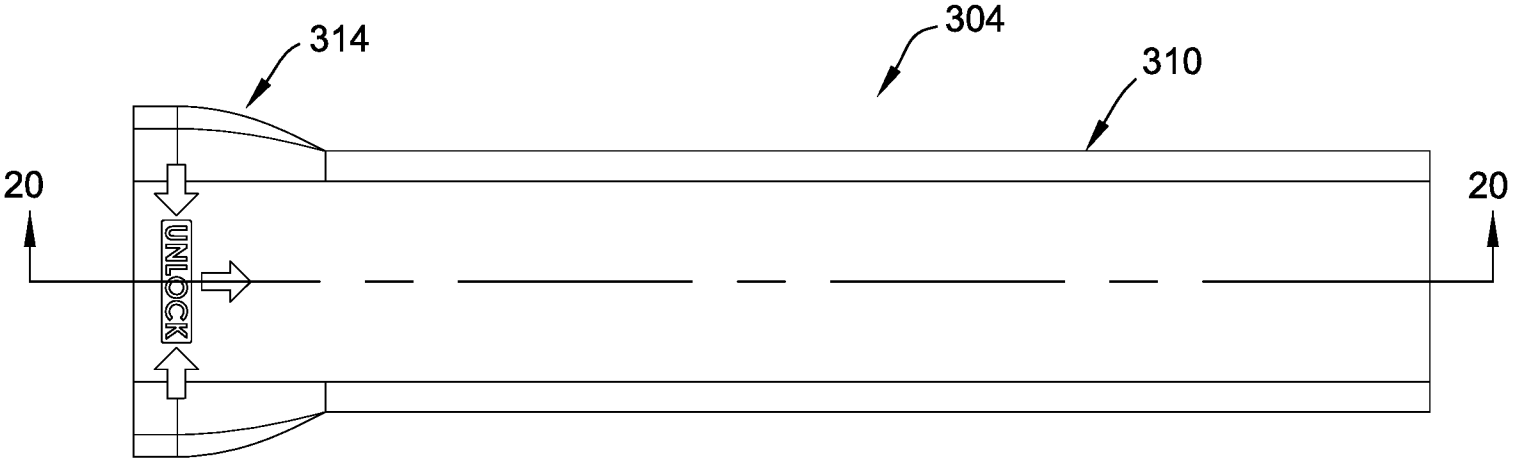
FIG. 17 is a side elevational view of the cover piece shown in FIG. 16.
Figure 40:
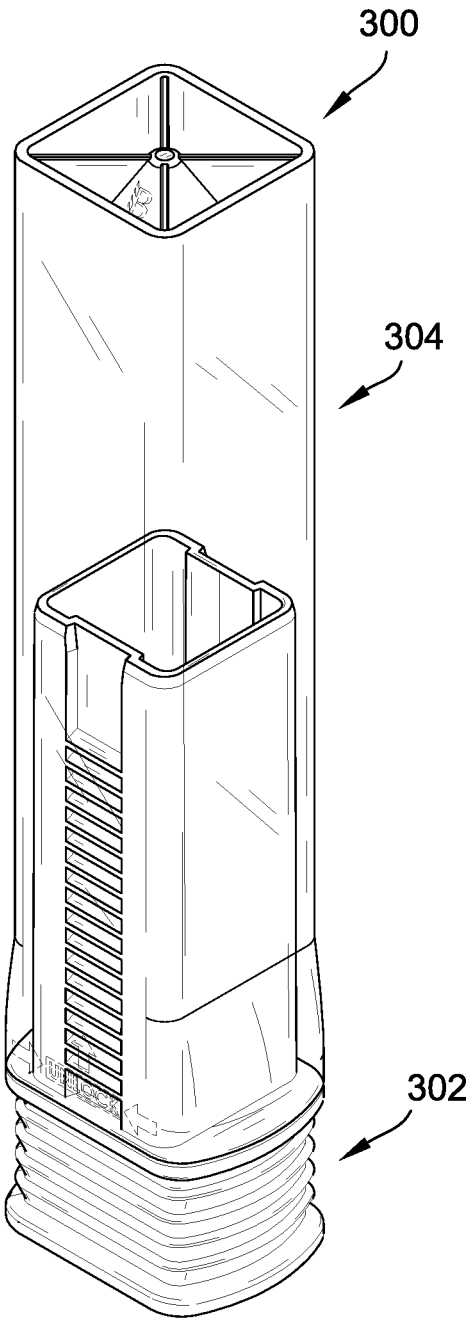
FIG. 40 is a perspective assembled view of the package shown in FIGS. 16-26 in a retracted position.
Figure 41:
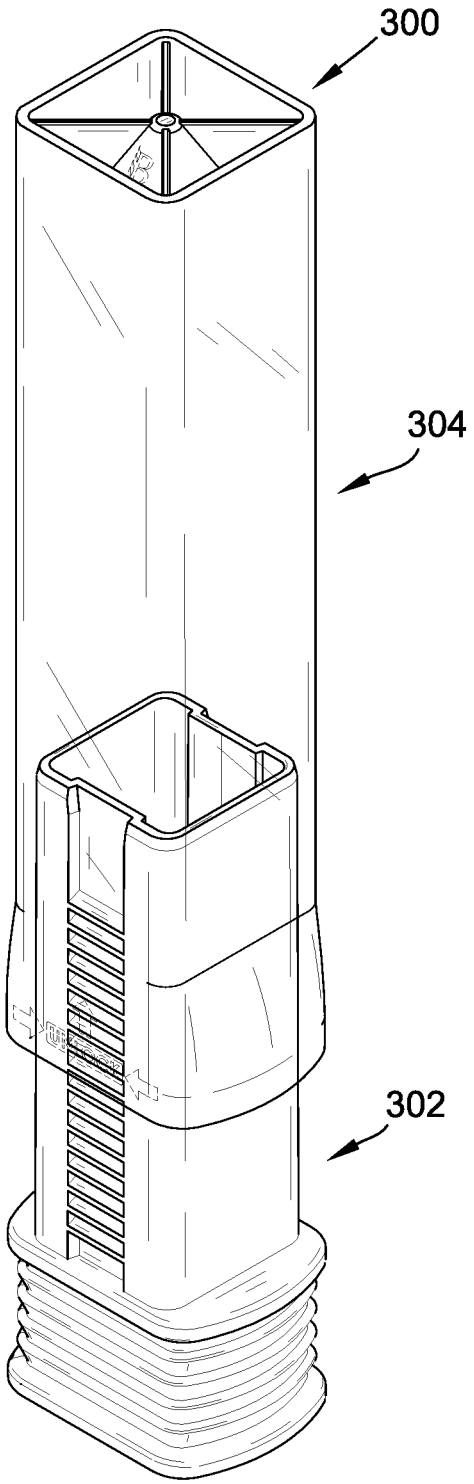
FIG. 41 is a perspective assembled view of the package shown in FIG. 40 in an extended position.

FIG. 16 shows the package assembly 300 in a disassembled state wherein the base piece 302 and cover piece 304 are separated from one another. FIGS. 40 and 41 show the assembled pieces 302 and 304 in a retracted position and extended position of the package 300. The base piece 302 and cover piece 304 are larger versions of the base piece 202 and cover piece 204 in the package assembly 100 and therefore each piece 302 and 304 defines larger interior spaces to accommodate larger items inside the package 300 that would not fit in the package 200. As such, the cap portion 310 and grip portion 314 of the cover piece 304 are modified relative to the cover piece 204 to have a larger inner and outer circumference and optionally a larger axial length as well. Likewise, the grip portion 352 and plug portion 356 of the base piece 302 are modified relative to the base piece 202 to have a larger inner and outer circumference and optionally a larger axial length.

Figure 19:
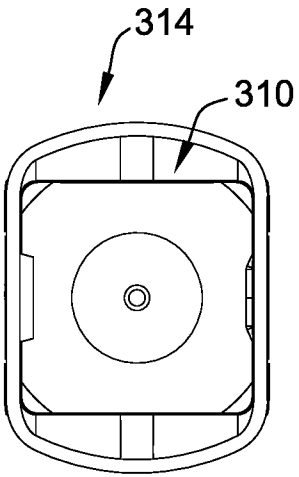
FIG. 19 is a bottom view of the cover piece shown in FIGS. 16 and 17.
Figure 18:
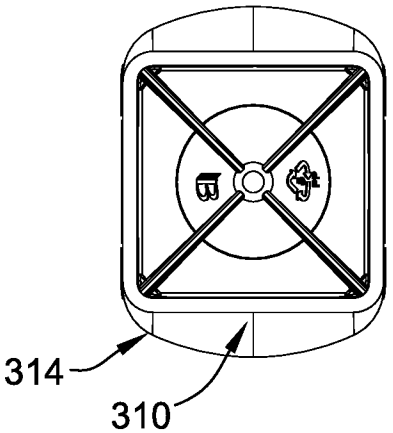
FIG. 18 is a top view of the cover piece shown in FIGS. 16 and 17.
Figure 20:
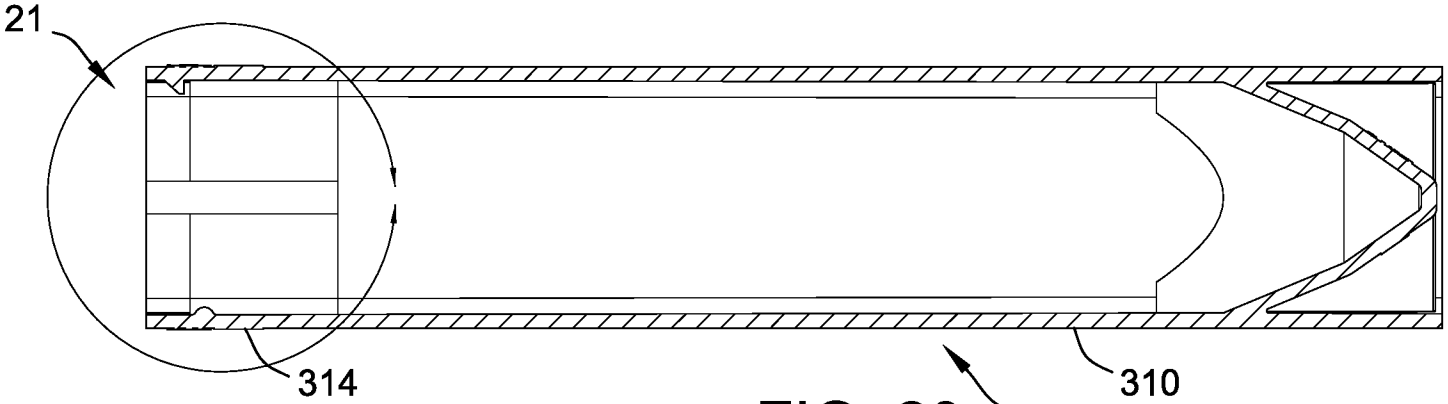
FIG. 20 is a sectional view of the cover piece taken along line taken along line 20-20 in FIG. 17.
Figure 21:
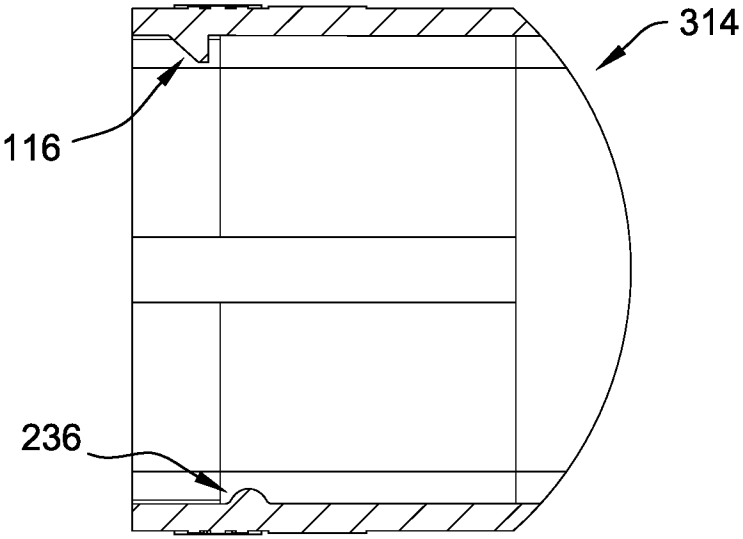
FIG. 21 is a detail view of a portion of FIG. 20.
Figure 22:
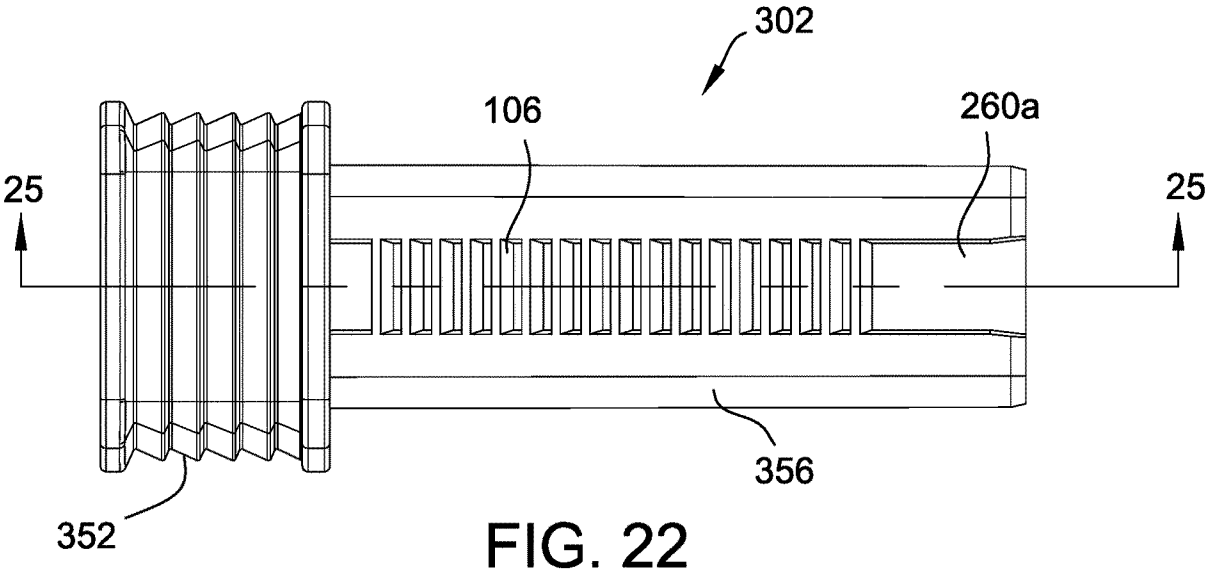
FIG. 22 is a side elevational view of the base piece shown in FIG. 16.
Figure 24:
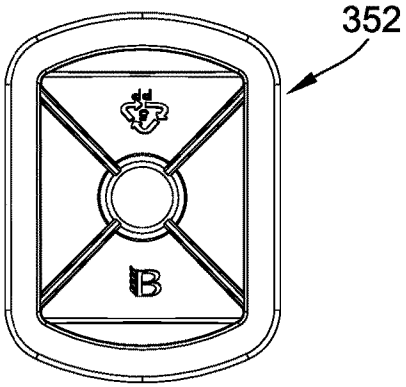
FIG. 24 is a bottom view of the base piece shown in FIGS. 16 and 22.
Figure 23:
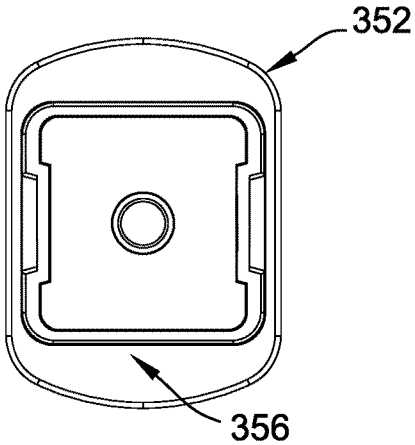
FIG. 23 is a top view of the base piece shown in FIGS. 16 and 22.
Figure 25:
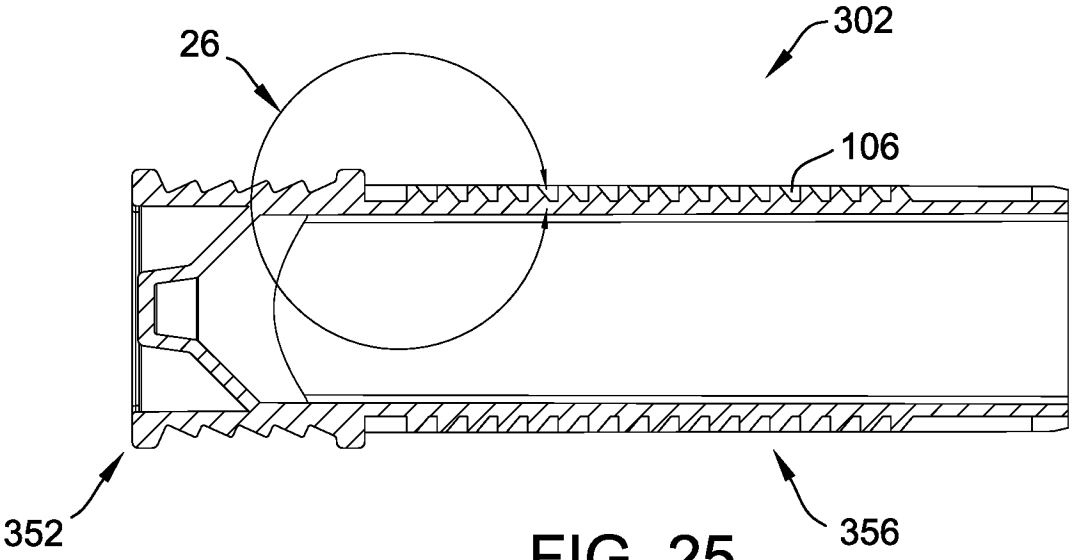
FIG. 25 is a sectional view of the base piece taken along line 14-14 in FIG. 22.
Figure 26:
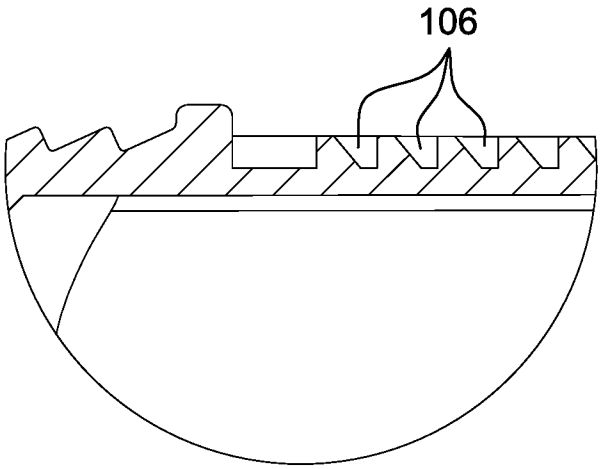
FIG. 26 is a detail view of a portion of FIG. 25.

Comparing FIGS. 16-18 and FIGS. 5-7, the flared side walls in the grip portion 314 are extended upon opposing longitudinal side walls of the cap portion 310 with a slightly more complex curvature than in the cover piece 204 but otherwise still realizing an oval-shaped grip portion in the proximal end view of FIG. 19. Specifically, the flared side walls in the grip portion 314 of the cover piece 304 includes discontinuities in curvature that is not present in the flared side walls of the cover piece 204. Otherwise, the pertinent features of the package pieces 302, 304 are the same or similar enough to the package pieces 202, 204 that further description of FIGS. 17-26 is believed to be unnecessary. The assembly, use, operation, and benefits of the package 300 are similar to the package 200.

FIGS. 27-37 and 42-43 illustrate aspects of a third exemplary embodiment of an axial center lock, grip release telescoping package assembly 400 including a base piece 402 and cover piece 404.

Figure 27:
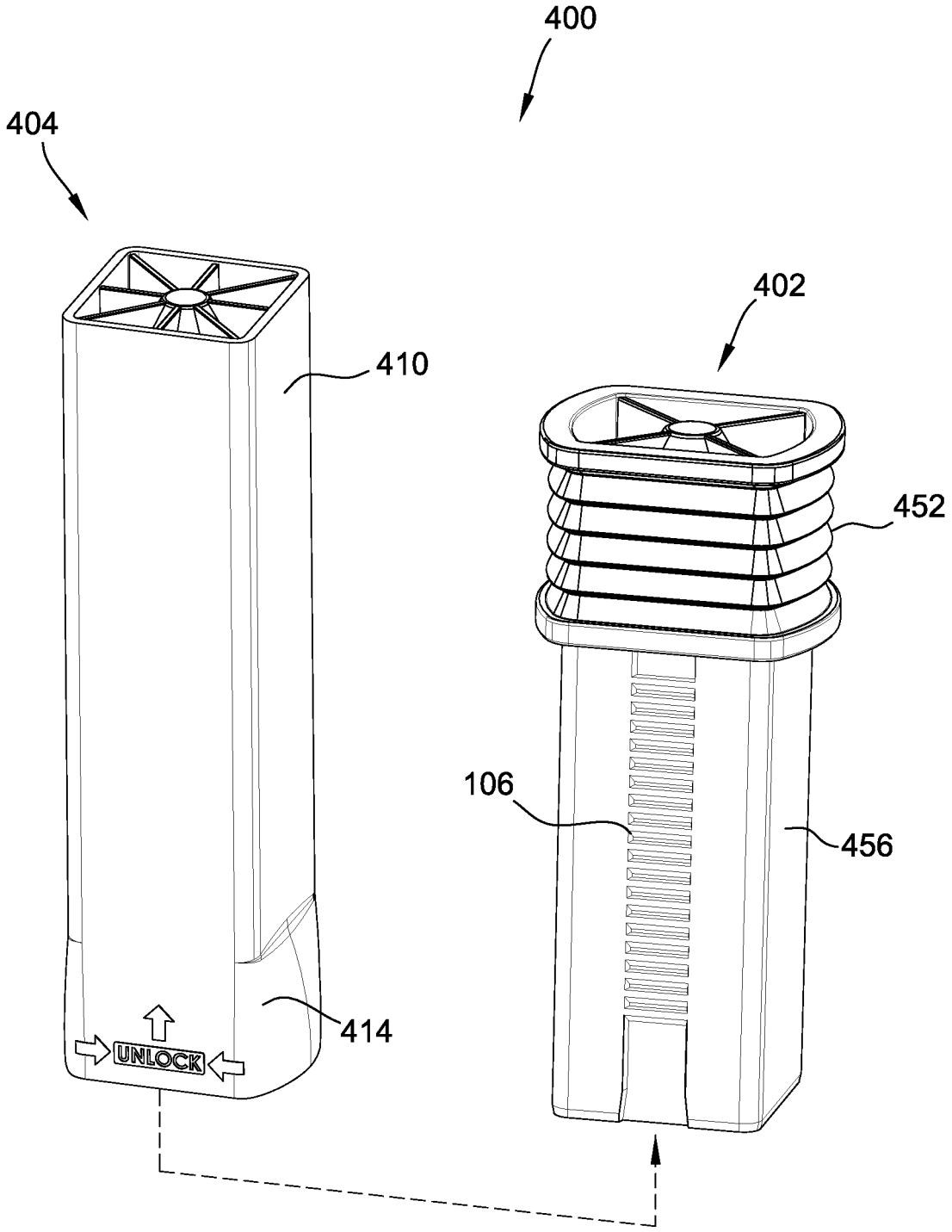
FIG. 27 is a third dis-assembled view of an exemplary axial center lock, grip release telescoping package assembly according to an exemplary embodiment of the present invention.
Figure 28:
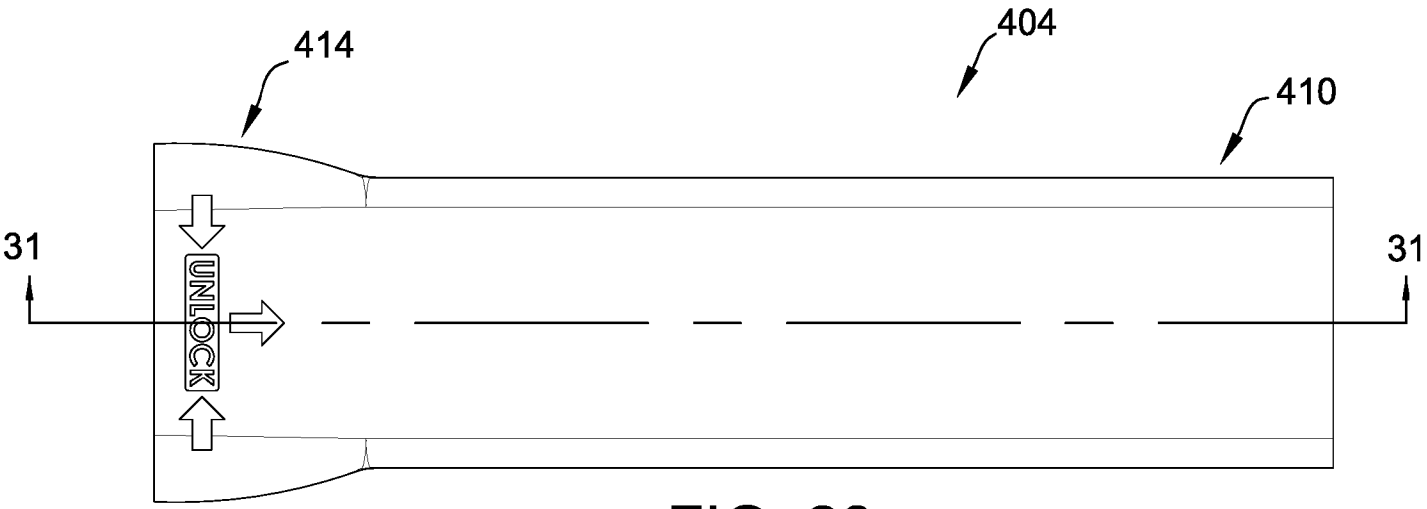
FIG. 28 is a side elevational view of the cover piece shown in FIG. 27.
Figure 30:
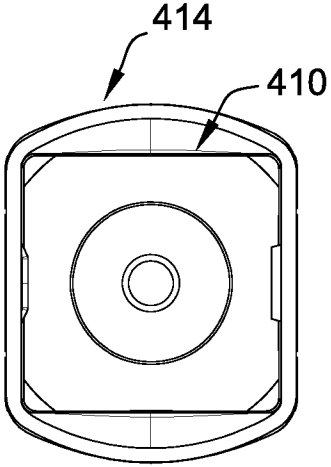
FIG. 30 is a bottom view of the cover piece shown in FIGS. 27 and 28.
Figure 29:
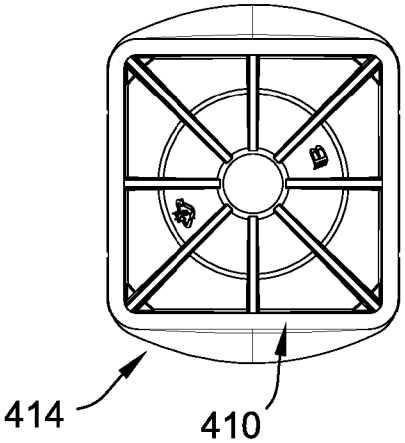
FIG. 29 is a top view of the cover piece shown in FIGS. 27 and 28.
Figure 31:
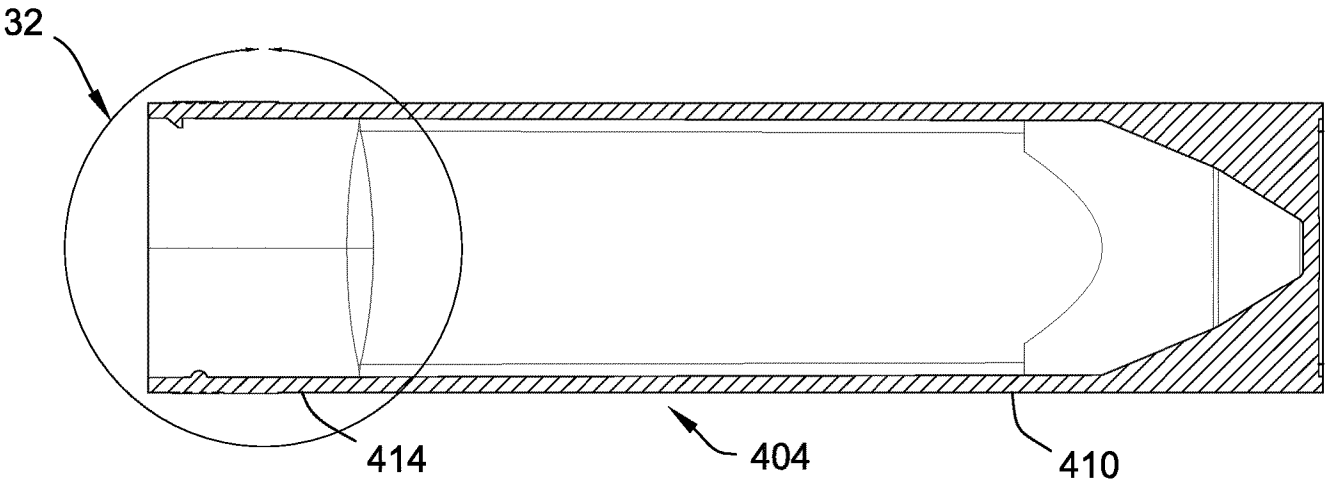
FIG. 31 is a sectional view of the cover piece taken along line taken along line 31-31 in FIG. 28.
Figure 32:
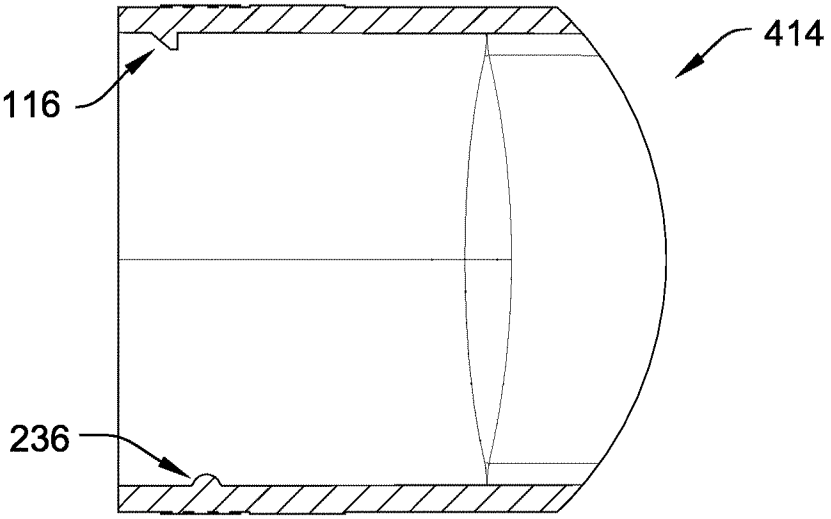
FIG. 32 is a detail view of a portion of FIG. 31.
Figure 33:
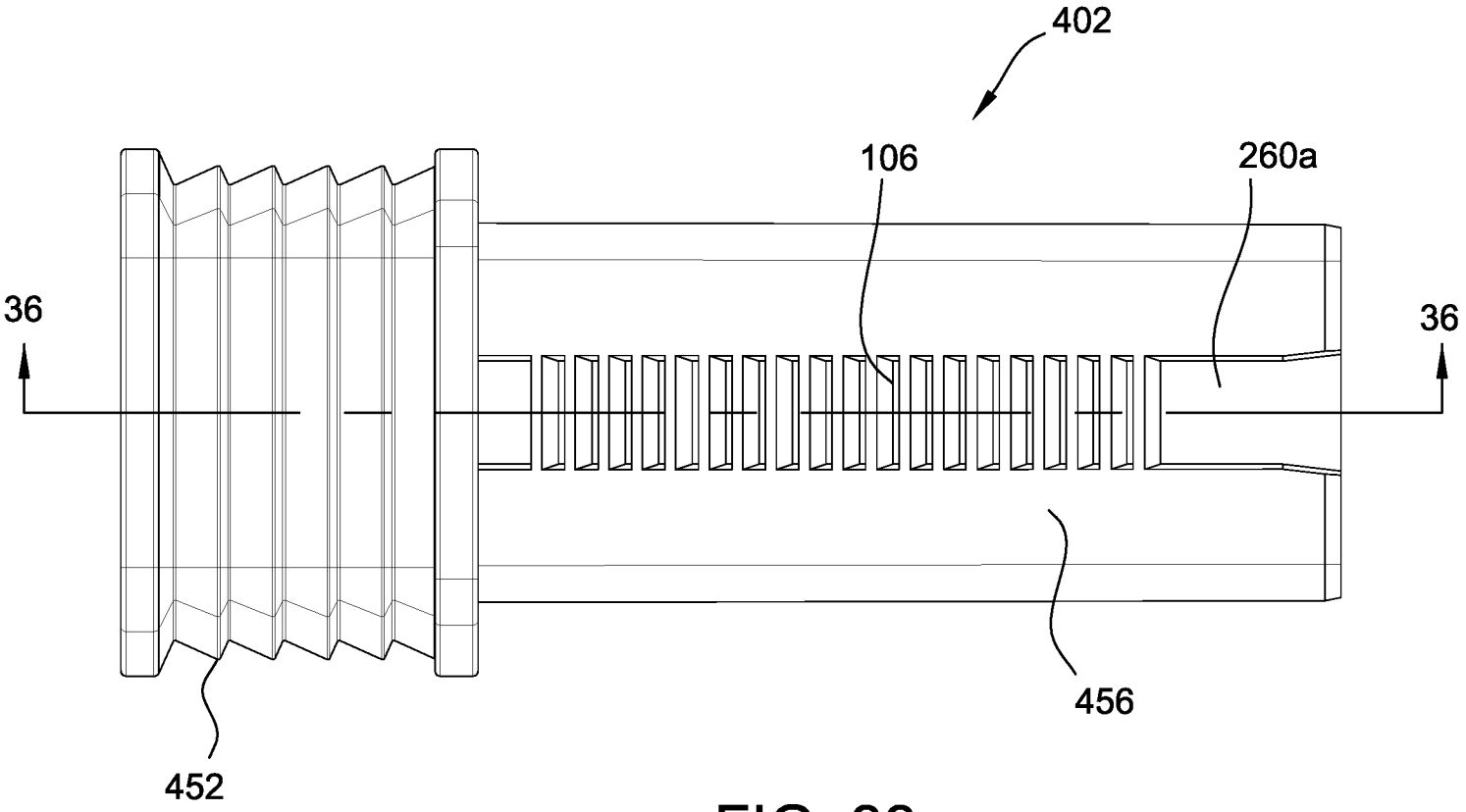
FIG. 33 is a side elevational view of the base piece shown in FIG. 27.
Figure 35:
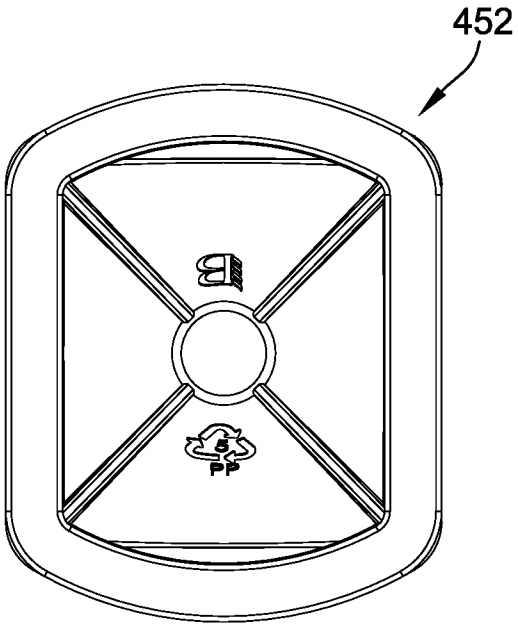
FIG. 35 is a bottom view of the base piece shown in FIGS. 27 and 33.
Figure 34:
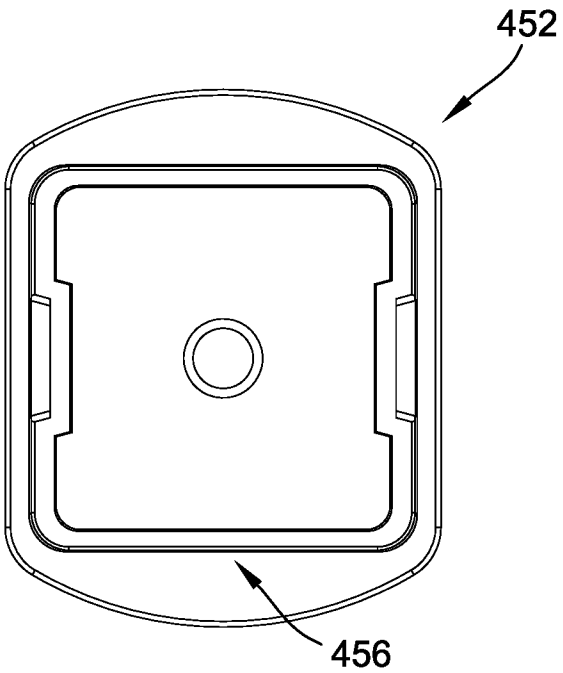
FIG. 34 is a top view of the base piece shown in FIGS. 27 and 33.
Figure 36:
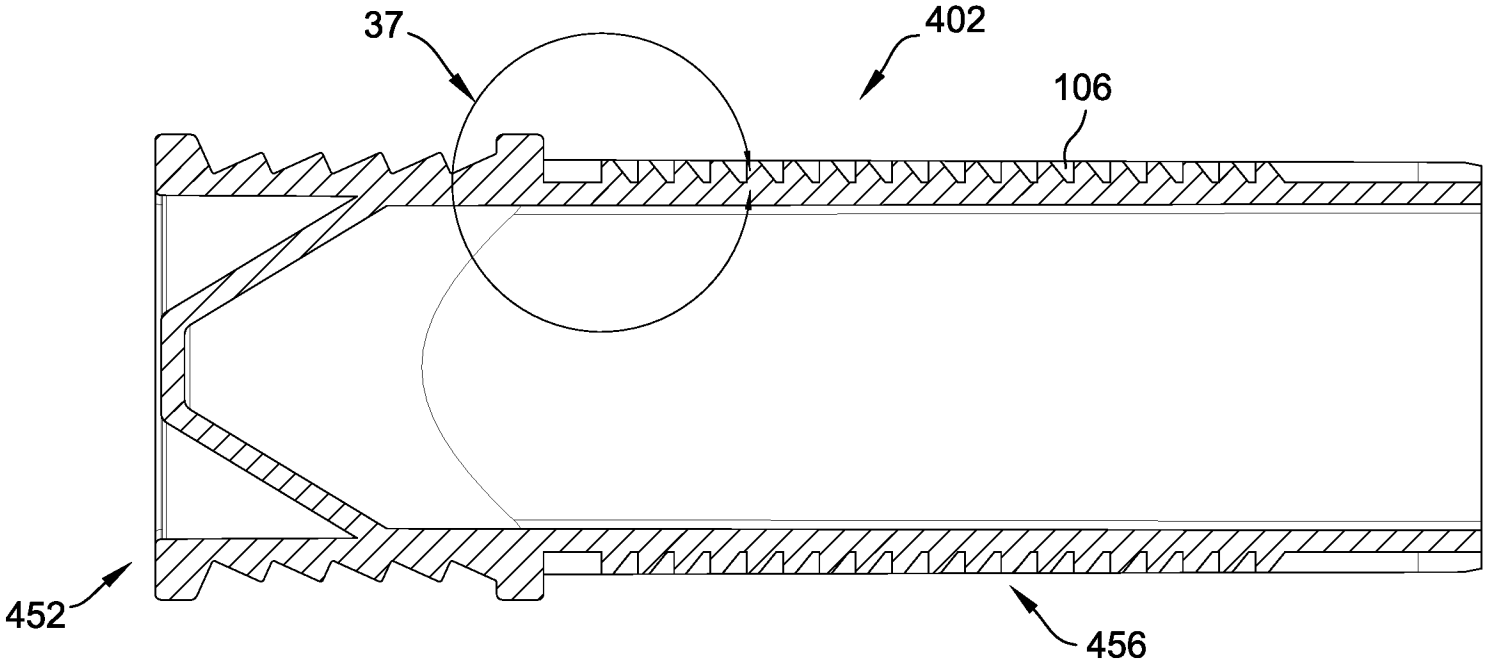
FIG. 36 is a sectional view of the base piece taken along line 36-36 in FIG. 33.
Figure 37:
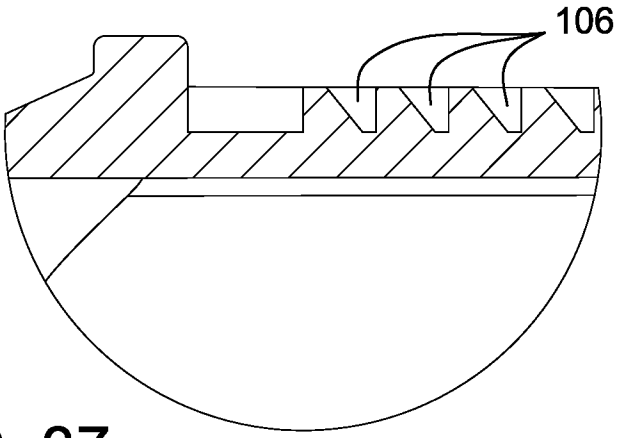
FIG. 37 is a detail view of a portion of FIG. 36.
Figure 42:
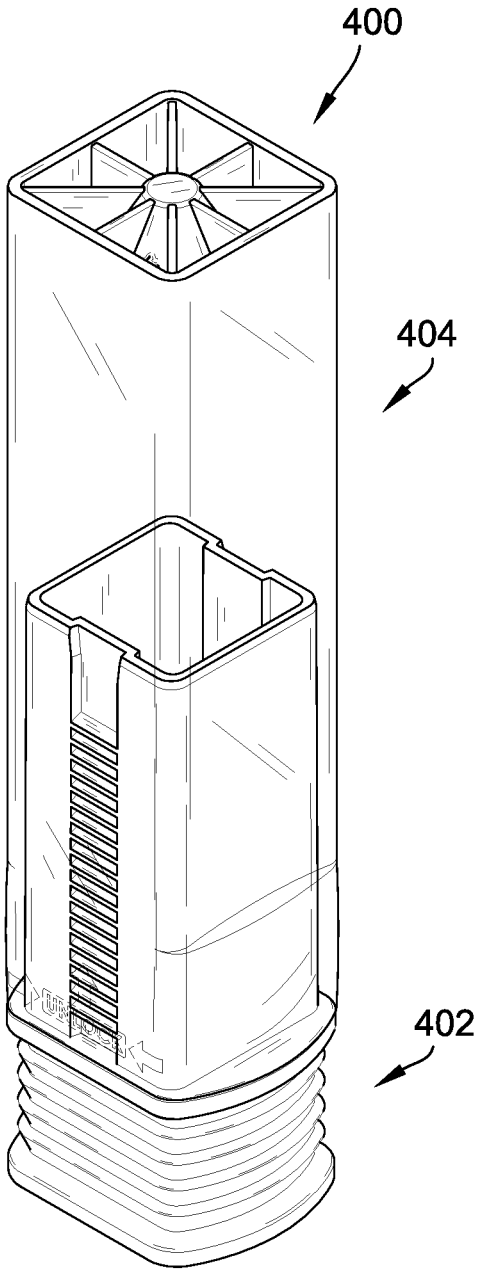
FIG. 42 is a perspective assembled view of the package shown in FIGS. 27-37 in a retracted position.
Figure 43:
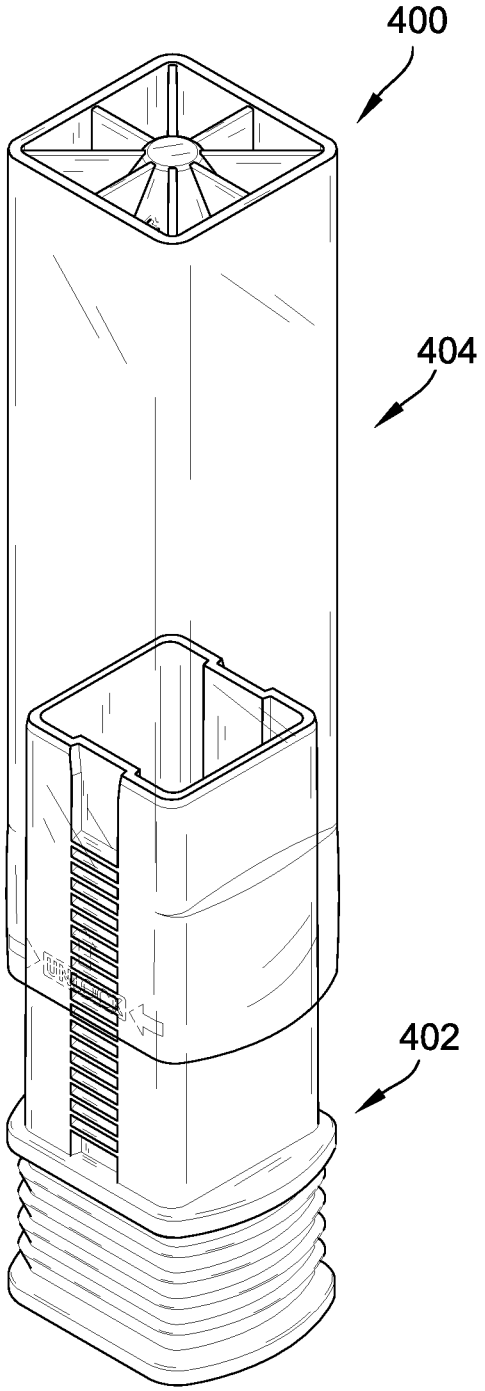
FIG. 43 is a perspective assembled view of the package shown in FIG. 40 in an extended position.

FIG. 27 shows the package assembly 400 in a disassembled state wherein the base piece 402 and cover piece 404 are separated from one another. FIGS. 42 and 43 show the assembled pieces 402 and 404 in a retracted position and extended position of the package 400. The base piece 402 and cover piece 404 are larger versions of the base piece 302 and the cover piece 304 in the package assembly 300 and therefore each define larger interior spaces to accommodate larger items inside the package 400. As such, the cap portion 410 and grip portion 414 of the cover piece 404 are modified relative to the cover piece 304 to have a larger inner and outer circumference and optionally a larger axial length as well. Likewise, the grip portion 452 and plug portion 456 of the base piece 402 are modified relative to the base piece 302 to have a larger inner and outer circumference and optionally a larger axial length.

Comparing FIGS. 28-30 and FIGS. 16-19, a simpler curvature in the flared side wall portions of the grip portion 414 in the cover piece 404 is seen relative to the grip portion 314 in the cover piece 304. The flared side walls in the grip portion 414 have two curved segments instead of three in the grip portion 314 to define the oval-shaped end. The molded features in the top view of FIG. 29 also includes additional cross-braces relative to the cover piece 304 shown in FIG. 18. While the cover piece 304 includes two diagonal cross-braces that resemble the letter x in the view of FIG. 18, the cover piece 404 includes two diagonal braces plus vertical and horizontal braces in the view of FIG. 29. The additional braces provide additional strength in the package 400 for the larger and heavier object to be contained. Alternative numbers of braces or alternative types of bracing are contemplated in further embodiments, and in certain cases the bracing could be considered optional and therefore may be omitted.

Except as noted above, the pertinent features of the package pieces 402, 404 are the same or similar enough to the packages 100, 200 and 300 that further description of FIGS. 28-37 is believed to be unnecessary. The use, operation, and benefits of the package 400 are similar to the package 300.

Adaptations of the package assemblies are contemplated wherein the relative orientations of lock projections and lock openings are reversed. For instance, and unlike the above examples, the lock projection 116 could be provided on the base piece while the lock openings 106 could be provided on the cover piece while otherwise producing a very similar operational result and similar locking and release capabilities as the flared side walls are caused to deflect the mating projection and opening features for release or engage them for locking when not deflected. In this case, the lock openings 106 would be deflected away from the lock projection 116 to release the cover to adjust the package length.

In another variation of the package design, the counter projection 236 could likewise be provided on the base piece while the lock openings 106 could be provided on the cover piece with similar operational result and benefit. The openings 106 could be deflected away from the counter projection 236 to release and unlock the cover piece.

Likewise, adaptations of the package assemblies are contemplated wherein combinations of lock projections and lock openings, and/or combinations of counter projections and lock openings, may be distributed on the base pieces or cover pieces. For instance, and unlike the above examples, the lock projection 116 could be provided on side of the plug portion of the base piece while the opposing side of the plug portion could include the series of lock openings 106. This could be paired with the counter projection 236 being provided on side of the cap portion of the cover piece while the opposing side of the cap portion could include the series of lock openings 106 while otherwise producing a very similar operational result and similar benefits. On one side of the package this would mean that the lock openings are deflected away from the lock projection while on the other side the counter projection would be deflected away from the lock openings, or vice versa.

The benefits of the inventive concepts are now believed to have been fully demonstrated in the exemplary embodiments disclosed.

A telescoping package assembly has been disclosed including a hollow base piece having a plug portion with at least one exterior flat surface and a hollow cover piece having a cap portion with at least one interior flat surface. Each of the at least one exterior flat surface and the at least one interior flat surface respectively includes opposed longitudinal side edges. One of the exterior flat surface and the interior flat surface includes a series of lock openings and wherein the other of the exterior flat surface and the interior flat surface includes a lock projection, with the series of lock openings and the lock projection each being spaced from the respective opposed longitudinal side edges of the exterior flat surface or the interior flat surface. The lock projection is selectively receivable in any one of the series of lock openings to adjust a length of the telescoping package assembly when the hollow base piece is engaged with the hollow cover piece. The hollow cover piece further includes a grip portion extending from the cap portion, the grip portion being operable to deflect the flat internal surface and release the lock projection from one of the series of lock openings when subjected to an applied pressing force.

Optionally, the grip portion may include a pair of outwardly flared side walls opposing one another, the outwardly flared side walls causing the flat internal surface to deflect when subject to applied pressure. The grip portion may have an oval-shaped end. The series of lock openings may be substantially centered between the opposed longitudinal side edges.

Also optionally, the series of lock openings may be formed in the plug portion. The plug portion may also include a longitudinal groove receiving the lock projection when the hollow base piece is received in the hollow cover piece, and the series of lock openings may be aligned with the longitudinal groove and extending flush with the exterior flat surface. The plug portion may include opposing exterior flat surfaces, with each of the opposing exterior flat surfaces including a series of lock openings. The plug portion may include four exterior flat surfaces arranged orthogonally to one another, and the four exterior flat surfaces may be about equally dimensioned to define an elongated square plug portion.

The hollow base piece may optionally include a grip portion extending from the plug portion. The grip portion may have a contoured exterior surface. The grip portion may be oval-shaped. The grip portion may have a larger outer circumference than the plug portion. The hollow base piece may also include a conical internal recess.

The hollow cover piece may optionally include a first flat interior surface and a second flat interior surface opposing the first flat interior surface. The lock projection may extend inwardly from the first flat interior surface, and a counter projection may extend inwardly from the second flat interior surface. The lock projection may have a first shape and the counter projection may have a second shape, with the second shape being different from the first shape. The second shape may be rounded, and the first shape may be wedge-shaped. The lock projection may be axially offset from the counter projection. Each of the first and second interior flat faces may include a series of lock openings or a lock projection. The hollow cover piece may include four internal flat surfaces arranged orthogonally to one another, and the four internal flat surfaces may be about equally dimensioned to define an elongated cap portion. The hollow cover piece may include a conical internal recess.

At least a portion of the hollow cover piece may optionally be transparent. An entirety of the hollow cover piece may also be transparent.

The hollow base piece or the hollow cover piece may optionally include a lock projection or a counter projection. The lock projection and the counter projection may be differently shaped from one another. The lock projection and the counter projection may be axially offset from one another. A single lock projection or a single counter projection may be included in the hollow base piece or the hollow cover piece.

The plug portion may optionally be receivable in and lockable to the cap portion without a relative rotation of the hollow base piece and the hollow cover piece. One of the hollow base piece and the hollow cover piece may optionally be provided with at least one visual indicator for reference by a person to unlock the hollow cover piece from the hollow base piece.

Another embodiment of a telescoping package assembly has been disclosed including a hollow base piece including a plug portion with an exterior surface, and a hollow cover piece including a cap portion with an interior surface. One of the interior or exterior surface includes a lock projection and the other of the interior or exterior surface includes a series of lock openings. The lock projection is selectively receivable in any one of the series of lock openings to adjust a length of the telescoping package assembly when the hollow base piece is engaged with the hollow cover piece, wherein the hollow cover piece further includes a deflectable flared wall portion extending outwardly and away from the cap portion, wherein the deflectable flared wall portion is operable to deflect the internal surface and release the lock projection from one of the series of lock openings when subjected to an applied pressing force.

Optionally, each of the exterior and interior surfaces respectively may include opposed longitudinal side edges. Each of the exterior and interior surface may include a flat surface between the opposed longitudinal side edges, with the series of lock openings and the lock projection each spaced from the respective opposed longitudinal side edges. The deflectable flared wall portion may have a first circumference and the cap portion may have a second circumference, wherein the first circumference is greater than the second circumference. The first circumference may have a first cross-sectional shape and the second circumference may have a second cross-sectional shape different from the first-cross sectional shape. The first or second cross sectional shape may be one of a circular shape, an elliptical shape, an oval shape, or a polygonal shape. The polygonal shape may be a square shape. The first cross-sectional shape may be an oval shape.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A telescoping package assembly comprising:

a hollow base piece including a plug portion with at least one exterior flat surface; and a hollow cover piece including a cap portion with at least one interior flat surface;

wherein each of the at least one exterior flat surface and the at least one interior flat surface respectively includes opposed longitudinal side edges;

wherein one of the exterior flat surface and the interior flat surface includes a series of lock openings and wherein the other of the exterior flat surface and the interior flat surface includes a lock projection, the series of lock openings and the lock projection each being spaced from the respective opposed longitudinal side edges of the exterior flat surface or the interior flat surface;

wherein the lock projection is selectively receivable in any one of the series of lock openings to adjust a length of the telescoping package assembly when the hollow base piece is engaged with the hollow cover piece; and wherein the hollow cover piece further comprises an oval-shaped end including a pair of outwardly flared side walls opposing one another, the outwardly flared side walls operable to cause the flat internal surface to deflect when subjected to an applied pressing force and deflect the flat internal surface and release the lock projection from one of the series of lock openings.

2. The telescoping package assembly of claim 1, wherein the series of lock openings are substantially centered between the opposed longitudinal side edges.

3. The telescoping package assembly of claim 1, wherein the series of lock openings are formed in the plug portion.

4. The telescoping package assembly of claim 3, wherein the plug portion further includes a longitudinal groove receiving the lock projection when the hollow base piece is received in the hollow cover piece, the series of lock openings aligned with the longitudinal groove and extending flush with the exterior flat surface.

5. The telescoping package assembly of claim 1, wherein the plug portion includes opposing exterior flat surfaces, each of the opposing exterior flat surfaces including a series of lock openings.

6. The telescoping package assembly of claim 5, wherein the plug portion includes four exterior flat surfaces arranged orthogonally to one another.

7. The telescoping package assembly of claim 6, wherein the four exterior flat surfaces are about equally dimensioned to define an elongated square plug portion.

8. The telescoping package assembly of claim 1, wherein the hollow base piece further comprises a grip portion extending from the plug portion.

9. The telescoping package assembly of claim 8, wherein the grip portion has a contoured exterior surface.

10. The telescoping package assembly of claim 8, wherein the grip portion is oval-shaped.

11. The telescoping package assembly of claim 8, wherein the grip portion has a larger outer circumference than the plug portion.

12. The telescoping package assembly of claim 1, wherein the hollow base piece further includes a conical internal recess.

13. The telescoping package assembly of claim 1, wherein the hollow cover piece includes a first flat interior surface and a second flat interior surface opposing the first flat interior surface.

14. The telescoping package assembly of claim 13;

wherein the lock projection extends inwardly from the first flat interior surface; and wherein a counter projection extends inwardly from the second flat interior surface.

15. The telescoping package assembly of claim 14, wherein the lock projection has a first shape and the counter projection has a second shape, the second shape being different from the first shape.

16. The telescoping package assembly of claim 15, wherein the second shape is rounded.

17. The telescoping package assembly of claim 15, wherein the first shape is wedge-shaped.

18. The telescoping package assembly of claim 14, wherein the lock projection is axially offset from the counter projection.

19. The telescoping package assembly of claim 13, wherein, each of the first and second interior flat faces includes a series of lock openings or a lock projection.

20. The telescoping package assembly of claim 13, wherein the hollow cover piece includes four internal flat surfaces arranged orthogonally to one another.

21. The telescoping package assembly of claim 19, wherein the four internal flat surfaces are about equally dimensioned to define an elongated cap portion.

22. The telescoping package assembly of claim 1, wherein the hollow cover piece further incudes a conical internal recess.

23. The telescoping package assembly of claim 1, wherein at least a portion of the hollow cover piece is transparent.

24. The telescoping package assembly of claim 23, wherein an entirety of the hollow cover piece is transparent.

25. The telescoping package assembly of claim 1, wherein the hollow base piece or the hollow cover piece further includes a counter projection extending opposite the lock projection.

26. The telescoping package assembly of claim 25, wherein the lock projection and the counter projection are differently shaped from one another.

27. The telescoping package assembly of claim 25, wherein the lock projection and the counter projection are axially offset from one another.

28. The telescoping package assembly of claim 25, wherein a single lock projection and a single counter projection is included in the telescoping package assembly.

29. The telescoping package assembly of claim 1, wherein the plug portion is receivable in and lockable to the cap portion without a relative rotation of the hollow base piece and the hollow cover piece.

30. The telescoping package assembly of claim 1, wherein one of the hollow base piece and the hollow cover piece is provided with at least one visual indicator for reference by a person to unlock the hollow cover piece from the hollow base piece.

31. A telescoping package assembly comprising:

a hollow base piece including a plug portion with an exterior surface; and a hollow cover piece including a cap portion with an interior surface;

wherein one of the interior or exterior surface includes a lock projection and wherein the other of the interior or exterior surface includes a series of lock openings;

wherein the lock projection is selectively receivable in any one of the series of lock openings to adjust a length of the telescoping package assembly when the hollow base piece is engaged with the hollow cover piece; and wherein an end of the hollow cover piece comprises a rounded side wall portion extending outwardly and away from the cap portion, wherein when the rounded side wall portion is subjected to an applied pressing force an inward bowing of the rounded side wall portion causes the exterior surface to deflect outwardly and release the lock projection from one of the series of lock openings.

32. The telescoping package assembly of claim 31, wherein each of the exterior and interior surface respectively includes opposed longitudinal side edges.

33. The telescoping package assembly of claim 32, wherein each of the exterior and interior surface include a flat surface between the opposed longitudinal side edges.

34. The telescoping package assembly of claim 33, wherein the series of lock openings and the lock projection are each spaced from the respective opposed longitudinal side edges.

35. The telescoping package assembly of claim 31, wherein the rounded side wall portion has a first circumference and wherein the cap portion has a second circumference, the first circumference being greater than the second circumference.

36. The telescoping package assembly of claim 35, wherein the first circumference has a first cross-sectional shape and wherein the second circumference has a second cross-sectional shape different from the first-cross sectional shape.

37. The telescoping package assembly of claim 36, wherein the first or second cross sectional shape is one of a circular shape, an elliptical shape, an oval shape, or a polygonal shape.

38. The telescoping package assembly of claim 37, wherein the polygonal shape is a square shape.

39. The telescoping package assembly of claim 36, wherein the first cross-sectional shape is an oval shape.

40. A telescoping package assembly comprising:

a hollow base piece including a plug portion with a first pair of opposing exterior flat surfaces; and a hollow cover piece including a cap portion with a second pair of opposing interior flat surfaces;

wherein each of the first pair of opposing exterior flat surfaces and the second pair of opposing interior flat surfaces respectively includes opposed longitudinal side edges;

wherein the hollow base piece and the hollow cover piece in combination define a lock projection, a counter projection, and a series of lock openings spaced from the respective opposed longitudinal side edges;

wherein the lock projection has a first shape and the counter projection has a second shape, the second shape being different from the first shape;

wherein the lock projection is selectively receivable in any one of the series of lock openings to adjust a length of the telescoping package assembly when the hollow base piece is engaged with the hollow cover piece.

41. The telescoping package assembly of claim 40, wherein the hollow cover piece further comprises a deflectable rounded end extending from the cap portion, the deflectable rounded end operable release the lock projection from one of the series of lock openings when subjected to an applied pressing force.

42. The telescoping package assembly of claim 40, wherein the lock projection extends inwardly from one of the pair of opposing interior flat surfaces; and wherein the counter projection extends inwardly from the other of the pair of opposing interior flat surfaces.

43. The telescoping package assembly of claim 40, wherein the lock projection is axially offset from the counter projection.

44. The telescoping package assembly of claim 40, wherein the second shape is rounded.

45. The telescoping package assembly of claim 40, wherein the first shape is wedge-shaped.

* * * * *